US011619460B2

(12) United States Patent
Fischer et al.

(10) Patent No.: US 11,619,460 B2
(45) **Date of Patent: *Apr. 4, 2023**

(54) ELECTRONIC MAGAZINE LOADER

(71) Applicant: Vista Outdoor Operations LLC, Anoka, MN (US)

(72) Inventors: Paul R. Fischer, Oxford, MS (US); William Hemeyer, Lees Summit, MO (US)

(73) Assignee: VISTA OUTDOOR OPERATIONS LLC, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/526,238

(22) Filed: Nov. 15, 2021

(65) Prior Publication Data

US 2022/0065568 A1 Mar. 3, 2022

Related U.S. Application Data

(63) Continuation of application No. 16/918,209, filed on Jul. 1, 2020, now Pat. No. 11,175,107, which is a continuation of application No. 16/242,297, filed on Jan. 8, 2019, now Pat. No. 10,704,850.

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
USPC ..... 42/87
See application file for complete search history.

(56) References Cited

U.S. PATENT DOCUMENTS

| | | | |
|---|---|---|---|
| 2,362,109 | A | 11/1944 | Whitmore |
| 2,384,140 | A | 9/1945 | Smith et al. |
| 4,881,447 | A | 11/1989 | Yanusko et al. |
| 4,939,862 | A | 7/1990 | Brandenburg et al. |
| 4,949,495 | A | 8/1990 | Mari |
| 4,970,820 | A | 11/1990 | Miller et al. |

(Continued)

OTHER PUBLICATIONS

International Search Report and Written Opinion dated Jun. 19, 2020, in related application PCT/US2020/012737.

*Primary Examiner* — Bret Hayes
(74) *Attorney, Agent, or Firm* — Walter M. Egbert, III; Richard J. Brown; Reed Smith LLP

(57) ABSTRACT

An electronic magazine loader for loading cartridges into a magazine includes a lifting wheel, a chute, and a magazine loading portion. The wheel receives an unordered batch of cartridges and singularly lifts and deposits the cartridges into the chute. The chute transfers the cartridges to the magazine loading portion where a setting mechanism inserts the cartridges into the magazine. A mechanism for directionally orienting the cartridges orients all cartridges to a proper directional orientation before reaching the magazine loading portion. The mechanism can be lifting wheel shelf structure or chute structure. The chute having a C-shaped portion above the magazine loading portion that precludes the cartridges from changing their proper directional orientation. The setting mechanism receives cartridges on a rotating wheel with rotating insertion lobes and cartridge receiving voids between adjacent lobes. The cartridges drop into a cartridge receiving void, and are urged into the magazine by a rotating lobe.

20 Claims, 24 Drawing Sheets

(56) References Cited

U.S. PATENT DOCUMENTS

| | | | | |
|---|---|---|---|---|
| 5,614,689 | A | 3/1997 | Gyre et al. | |
| 7,552,668 | B1 | 6/2009 | Gonzalez | |
| 9,989,342 | B1 | 6/2018 | Lougeay et al. | |
| 10,156,408 | B1 | 12/2018 | Buckner | |
| 10,527,376 | B2 | 1/2020 | Slevin et al. | |
| 11,175,107 | B2 * | 11/2021 | Fischer | F41A 9/83 |
| 2013/0152771 | A1 | 6/2013 | Coma | |
| 2014/0373421 | A1 | 12/2014 | Hatch | |
| 2016/0102932 | A1 | 4/2016 | Cobb | |
| 2016/0202007 | A1 | 7/2016 | Hatch | |
| 2016/0305726 | A1 | 10/2016 | Mokuolu | |
| 2019/0226780 | A1 | 7/2019 | Slevin et al. | |
| 2019/0226781 | A1 | 7/2019 | Derus et al. | |

* cited by examiner

ELECTRONIC MAGAZINE LOADER

RELATED APPLICATIONS

This application is a continuation of U.S. application Ser. No. 16/918,209, filed Jul. 1, 2020, which is a continuation of U.S. application Ser. No. 16/242,297, filed Jan. 8, 2019, now U.S. Pat. No. 10,704,850, issued Jul. 7, 2020, the disclosures of which are hereby incorporated by reference in their entirety.

BACKGROUND OF THE DISCLOSURE

In order to maintain their proficiency with firearms, military personnel, law enforcement officers and hunters frequently engage in target practice. Target practice is often performed at a shooting range with hundreds cartridges being fired at each practice session. In the sport of hunting, marksmanship is practiced so that a shot can be carefully placed to ensure a quick, clean and humane kill. For military personnel, good marksmanship may make the difference between victory and defeat in battlefield situations.

Many firearms, including pistols and rifles, are designed to utilize a removable magazine that holds ammunition cartridges. The use of a magazine allows a plurality of stacked cartridges to be easily loaded into the firearm by inserting a single magazine into the firearm. After each cartridge is fired, a manually or automatically operated mechanism moves the bolt of the firearm backward and then forward again. The upper-most cartridge is pulled off the stack of cartridges in the magazine each time the mechanism cycles so that cartridges are fed one-by-one into the firing chamber of the firearm. Each magazine typically has an elongate housing defining a chamber with a spring loaded follower slidably disposed therein. The force of the spring loaded follower urges each cartridge in the magazine toward the upper-most position in the where the bolt can push it into the firing chamber. When all of the cartridges have been fired, the empty magazine is removed from the firearm and a new magazine is inserted in its place. The empty magazine may then be refilled with cartridges. Loading such cartridges manually has been tedious and time consuming. Although devices have been provided to assist in such manual loading, improvements and automating the loading functions in an economical device would be well received.

SUMMARY

A motorized magazine loader for loading cartridges into a magazine includes a powered wheel for lifting a series of cartridges from an unordered batch of cartridges placed in an interior of the wheel to an elevated discharge region, a transfer portion that transfers the series of cartridges from the elevated discharge region to a magazine loading portion where the cartridges are loaded into the magazine. A cartridge directional orientation means orients the cartridges, so they are all commonly and properly oriented for insertion in the magazine. In embodiments, the transfer portion comprising a chute with a C-shaped portion leading to the setting tool. The axis of the "C" being parallel to the lengthwise axis of the cartridges. The C-shaped portion maintaining the cartridges in a horizontal and common directional orientation and controlling the dropping velocity of each of the series of cartridges. The cartridge directional orientation may occur as the cartridges are being elevated at the lifting wheel or as they are being transferred at the transfer portion.

The magazine loading portion has a powered rotating setting tool for urging the cartridges, one-by-one, into the magazine.

In embodiments, the setting tool comprises a powered rotating loading wheel with a central portion and two lobe portions disposed on opposite sides of the central portion with cartridge receiving void being disposed between the lobes of the setting tool. The cartridges seat on an upward facing surface of the rotating loading wheel. The rotating cartridge setting wheel located below an exit slot of the chute such that the cartridges individually and initially seat on a top surface of the rotating setting wheel and as the setting tool rotates, each of the series of cartridges fall into one of the pair of cartridge receiving voids where it is positionally constrained and pushed by one of the pair of lobes into a magazine secured by the magazine loading portions.

In embodiments, a motorized magazine loader for loading cartridges into a magazine includes a chassis and/or housing supporting a powered cartridge sorting and lifting wheel, a cartridge transfer portion, a magazine loading portion, and a cartridge directional orientation means associated with the sorting and lifting wheel. Each cartridge comprising a casing and a projectile, being elongate, with an axis, and having opposing ends with a bullet or projectile tip at a forward end and a casing rim at a rearward end. The powered rotatable wheel having an open interior and circumferentially spaced singularizing lifting shelves, each shelf defining a cartridge lifting pocket. The pockets elongate in a direction parallel to or generally parallel to the axis of rotation of the wheel, the pockets receive and lift the cartridges, serially (one by one), after an unordered batch of cartridges is loosely placed in a cartridge receiving region that is at least partially defined by the interior of the wheel. The cartridges are raised to a discharge region, such as a slot, with only correctly oriented cartridges reaching the discharge region. In embodiments a cartridge directional orienting means comprises each shelf configured to hold and lift the cartridges to the cartridge discharge region in only a single orientation. For example, the shelf having two shelf ends with one raised end and one end muted or missing such that the raised shelf end that receives the casing end of the cartridge maintains the cartridge in the shelf as it is lifted to the discharge region. When the projectile end of the cartridge is at the raised shelf end of the pocket, the cartridge is not adequately supported as it is being raised to the discharge region and the cartridge falls out of the shelf before reaching the discharge region. This allows only cartridges with a selected directional orientation to be deposited to the discharge region into the chute. In embodiments, the shelf may be conformingly shaped to the cartridge such that the cartridge does not seat or does not fully seat in the conforming pocket unless it is correctly oriented. When the cartridge not fully seated and is raised during the rotation of the wheel, the cartridge falls out of the pocket before reaching the discharge region. Fully seated cartridges are retained in the conforming pocket and are discharged at the discharge region. The cartridges that are not retained fall back to the receiving region to be again picked up by a shelf. The process continues until all cartridges are ultimately properly oriented and lifted and discharged at the discharge region.

In embodiments a cartridge directional orienting means provides a cartridge deflector that extends into an end region of the cartridge receiving pocket and is fixed with respect to the housing or chassis; the deflector configured and positioned to not engage the cartridge when the projectile end of the cartridge is at the end region where the deflector is positioned. When the casing end of the cartridge is at the end region where the deflector is positioned the deflector interferes with the casing end as the cartridge is being raised and ejects the cartridge from the cartridge receiving pocket before the pocket and cartridge reach the discharge region. The cartridge falls to the receiving region to be again picked up by a shelf. The process continues until all cartridges are ultimately properly oriented and lifted to the discharge region.

A feature and advantage of the cartridge orienting means being associated with the sorting and lifting wheel is that the transfer portion can be greatly reduced in length as the cartridges are already directionally oriented as they enter the transfer portion. The reduced length of the transfer portion permits raising the magazine loading portion allowing, for example, a magazine receiver to be close in height to a cartridge batch loading hopper.

In embodiments, a cartridge directional orientation means is provided by the cartridge transfer portion. The cartridge transfer portion comprising a chute generally having a passageway with generally rectangular cross section and lesser dimension, a passageway thickness, of slightly greater than a maximum diameter of the cartridges and a greater dimension of the rectangular cross section of the passageway being greater that the length of the cartridges. The cartridge directional orienting means comprising a chute having an upper portion with an opposing restrictive structure narrowing the thickness of the passageway on each of two ends of an upper portion of the passageway defined by the chute, but not in a middle portion of the upper portion of the passageway. The restrictive structures sized to allow the forward end of the cartridge, due to the tapering and reduced diameter of the forward projectile end, to fall downward, however, the restrictive structures prevent the rearward casing end of the cartridge to pass through due to the cylindrical shape and the greater diameter of the rearward casing portion. As the forward end falls the cartridge rotates such that the rearward end is upwardly from the forward end and the rearward end becomes centered in the upper portion where there is no restrictive structure, allowing the cartridge to fall, forward end or tip end first. The shape of the chute then narrows and sweeps to a horizontal direction forcing each cartridge to rotate as it travels down the chute to a horizontal orientation and then each cartridge drops or rolls downwardly to the magazine loading portion.

In embodiments, particularly suitable for handling pistol cartridges, having aspect ratios of bullet length to a maximum bullet diameter of 1.05 to 2.00. In embodiments, the cartridges are "rimless" with the rim or flange of the cartridge not extending radially outward beyond the cylindrical portion of the casing. For these handgun cartridges, there is the potential that the cartridges may rotate in the chute as they drop even after being initially directionally oriented. A feature and advantage of embodiments is to provide the chute with a curved C-shaped chute portion, the curvature, that is, the C shape, having an axis parallel to the lengthwise axis of the cartridges. The chute curvature precluding the cartridges from rotating other than about the cartridges own lengthwise axis. That is, the cartridges may slide or roll down the C-shaped chute portion but cannot flip to a different directional orientation. Such flipping may be precluded by clearance limitation of the curved chute walls and also inhibited by the rolling action imparted to the cartridges by the inclined chute surfaces. More than one C-shaped section may be provided. For example, the chute may be S-shaped. The C-shaped chute portion along with a short vertically straight portion therebelow may form an accumulator portion for stacking of cartridges above the magazine loading portion.

A feature and advantage of embodiments having a C-shaped chute portion as part of the transfer portion is that the cartridges are precluded from "free falling" thereby slowing their velocity and minimizing or eliminating damage, such as by dings on the surface of the cartridge or projectile.

A feature and advantage of embodiments with the curved chute portions is less noise being generated during operation of the device as compared to a comparable device with free falling cartridges.

A feature and advantage of embodiments is a motorized cartridge loader that can load cartridges particularly suitable for handguns, such as those with the bullets having an aspect ratio of 1.05 to 2.00. C-shaped curved sections in the transfer portion eliminates changes in cartridge directional orientation as the cartridge is being transferred to a magazine loading portion.

A feature and advantage of the magazine loader is that the arrangement of the components provides a compact motorized desktop magazine loader suitable for transporting such as to the range and suitable for use on a desk top or bench top and particularly suitable for loading handgun cartridges into handgun magazines.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
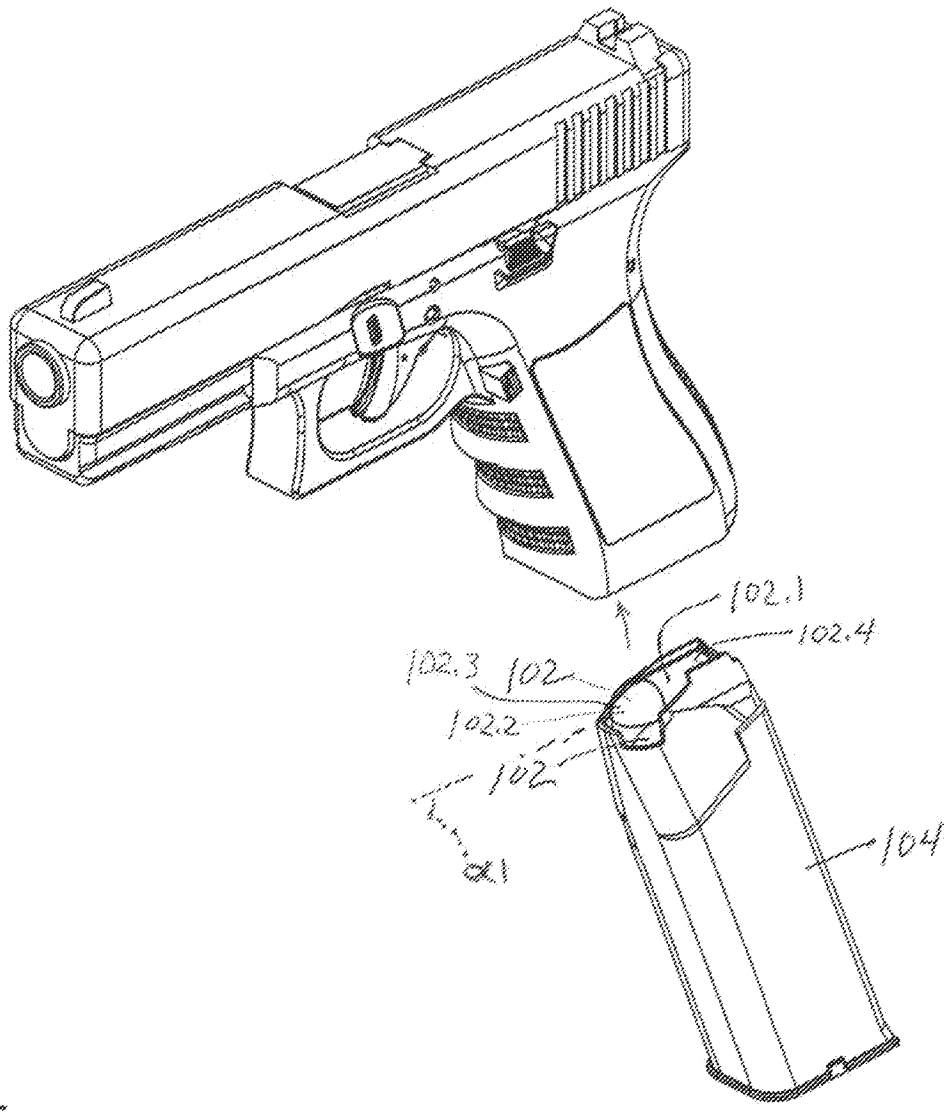
FIG. 1 PRIOR ART
FIG. 1 is a perspective view showing a prior art firearm and a magazine containing a stack of cartridges.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1 a prior art handgun receives a magazine 104 loaded with handgun cartridges 102. Each cartridge comprising a casing 102.1 and a projectile 102.2, being elongate, with an axis $\alpha$1, and having opposing ends, a forward or projectile end 102.3 and a rearward or casing end 102.4. Referring to FIGS. 2A and 3B, embodiments of a motorized magazine loader 100 receive a batch 103 of the cartridges 102 into a receiving region 105 of the magazine loader to load the cartridges into a magazine 108.

Referring to FIGS. 2A to 3C and 15A, the magazine loader 100 includes a powered lifting wheel 106 rotatable about a horizontal axis of rotation $\alpha$2, the lifting wheel powered by a motor 107, a transfer portion 108 configured as a cartridge chute that may include a curved portion 111 and an accumulator portion 109, and a magazine loading portion 110 including a cartridge setting mechanism 112 for inserting cartridges 102 in the magazine and a magazine receiving portion 113, all supported by a chassis and/or housing 140. The powered rotatable lifting wheel 106 having a circular plate 129, an outer periphery 131, peripheral ring structure 131.1, an open interior 130 with circumferentially spaced singularizing lifting shelves 146 as part of the peripheral ring structure 130.1. In embodiments, the wheel 106 at the peripheral ring structure 129.1 having a multiplicity of open windows 147 facing radially outward, one of said windows positioned at each shelf 146. In embodiments, the wheel 106 rotatable within a cylindrical wall 148 fixed with respect to the chassis and/or housing 140 such that each shelf 146 and the cylindrical wall portion 148 exposed at the respective window 147 defines the pocket 114. The pockets 114 elongate in a direction parallel to the axis of rotation $\alpha$2 of the wheel 106, the pockets 114 receive and lift the cartridges 102, in embodiments, serially (one by one), after an unordered batch of cartridges 102 is loosely placed inside the interior 130 of the wheel 106. The individual cartridges 102 are aligned in the pockets 114 parallel to or generally parallel to the axis of rotation but are not oriented, at least initially, with respect to which of two ways the forward and rearward ends are directed.

Figure 2B:
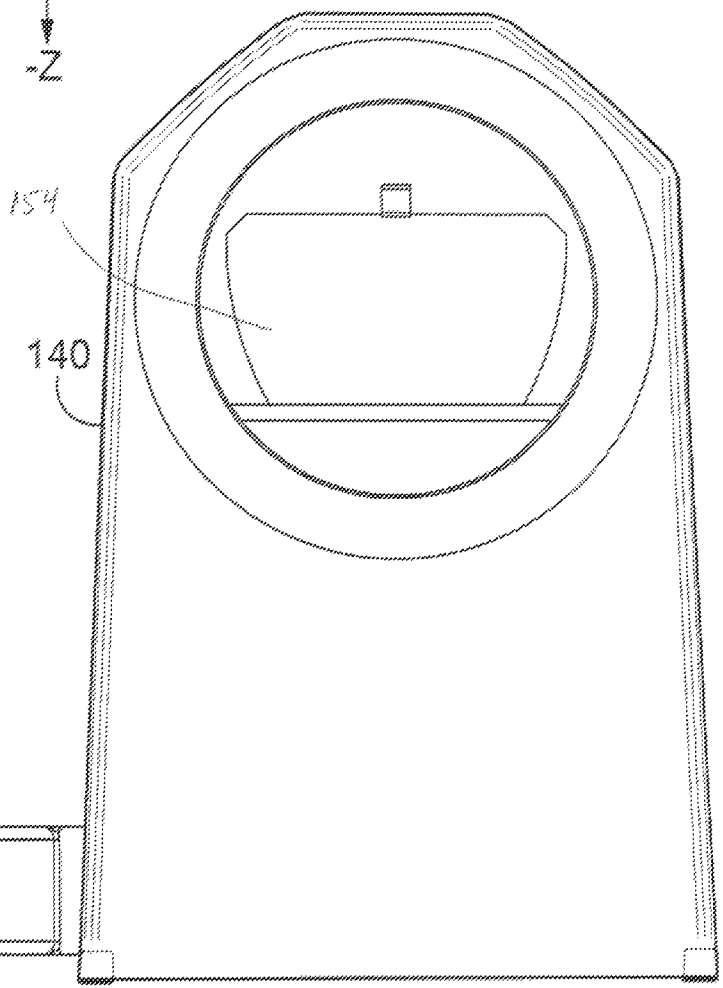
FIG. 2B is a right-side elevation view of the magazine loader shown in FIG. 3A
Figure 2A:
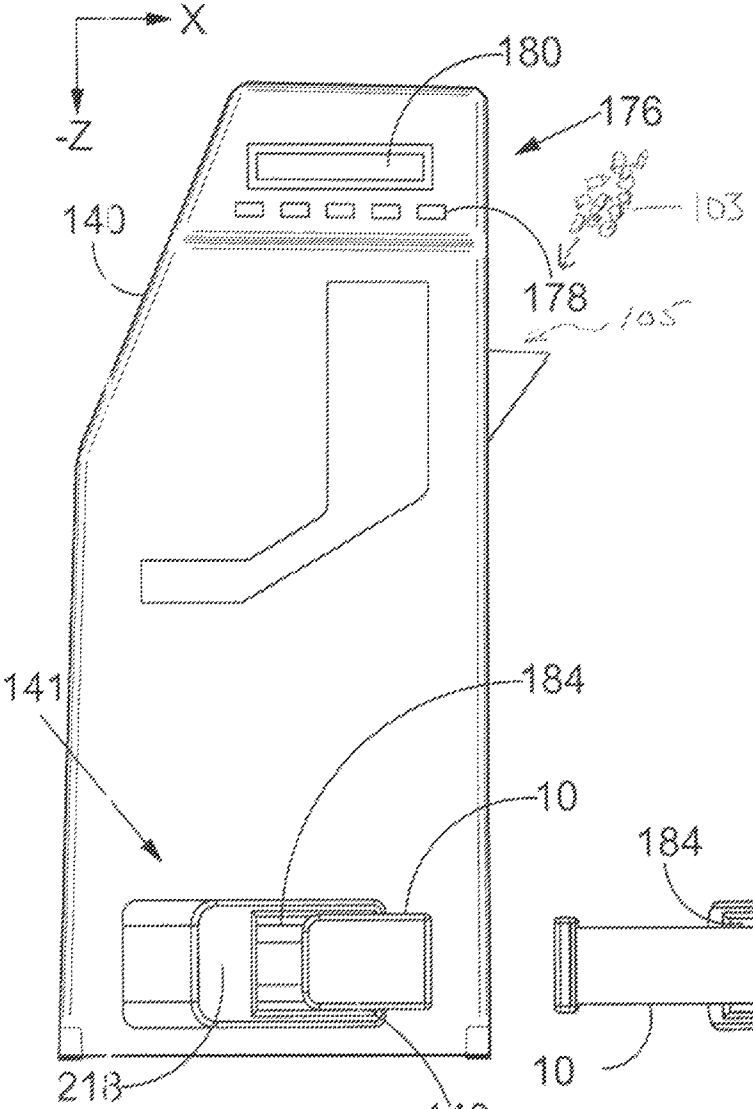
FIG. 2A is a front elevation view of a magazine loader.
Figure 3A:
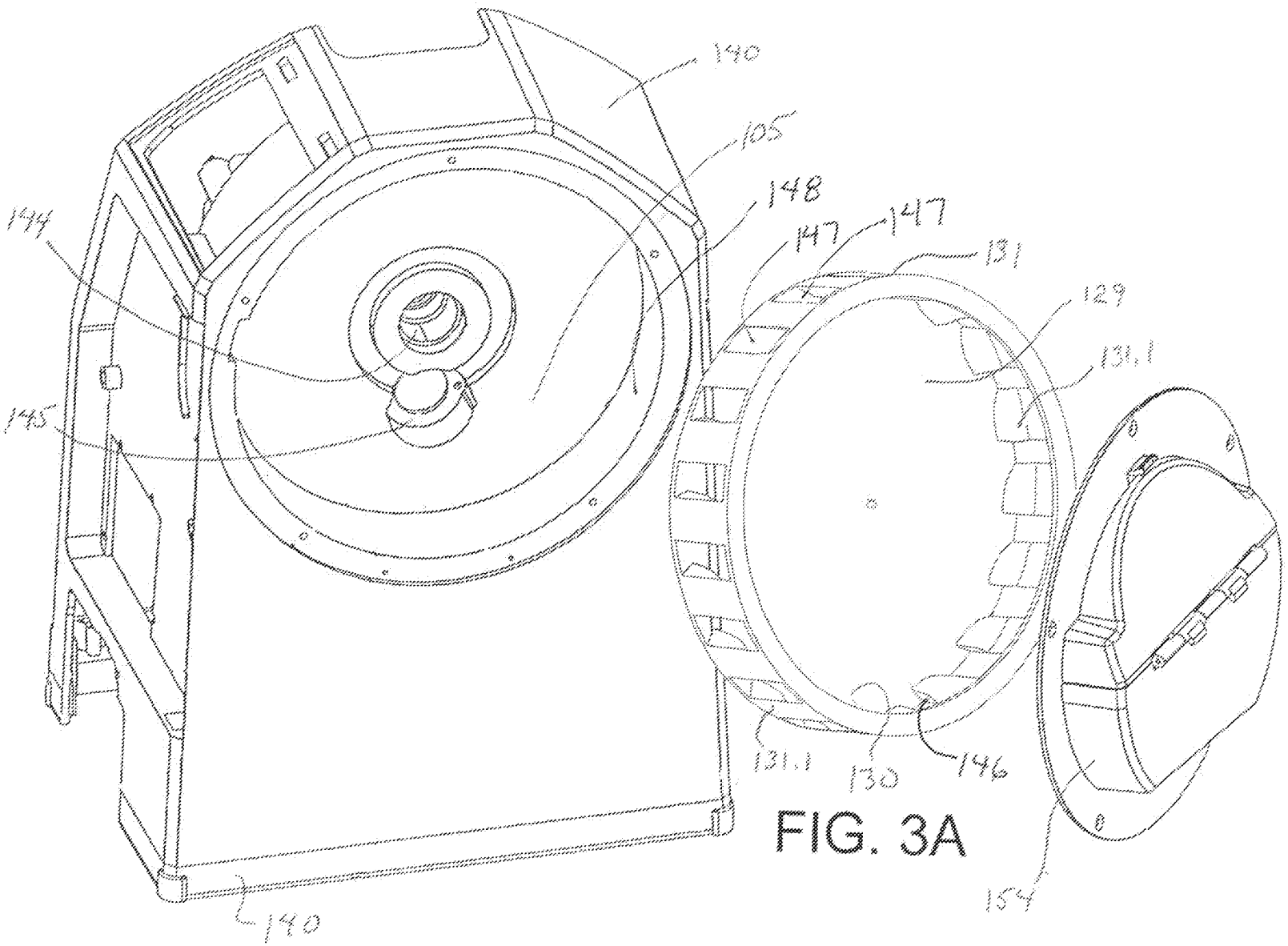
FIG. 3A is a partial exploded view of a magazine loader showing the chassis or housing and a lifting wheel and a cover and hopper.
Figure 3B:
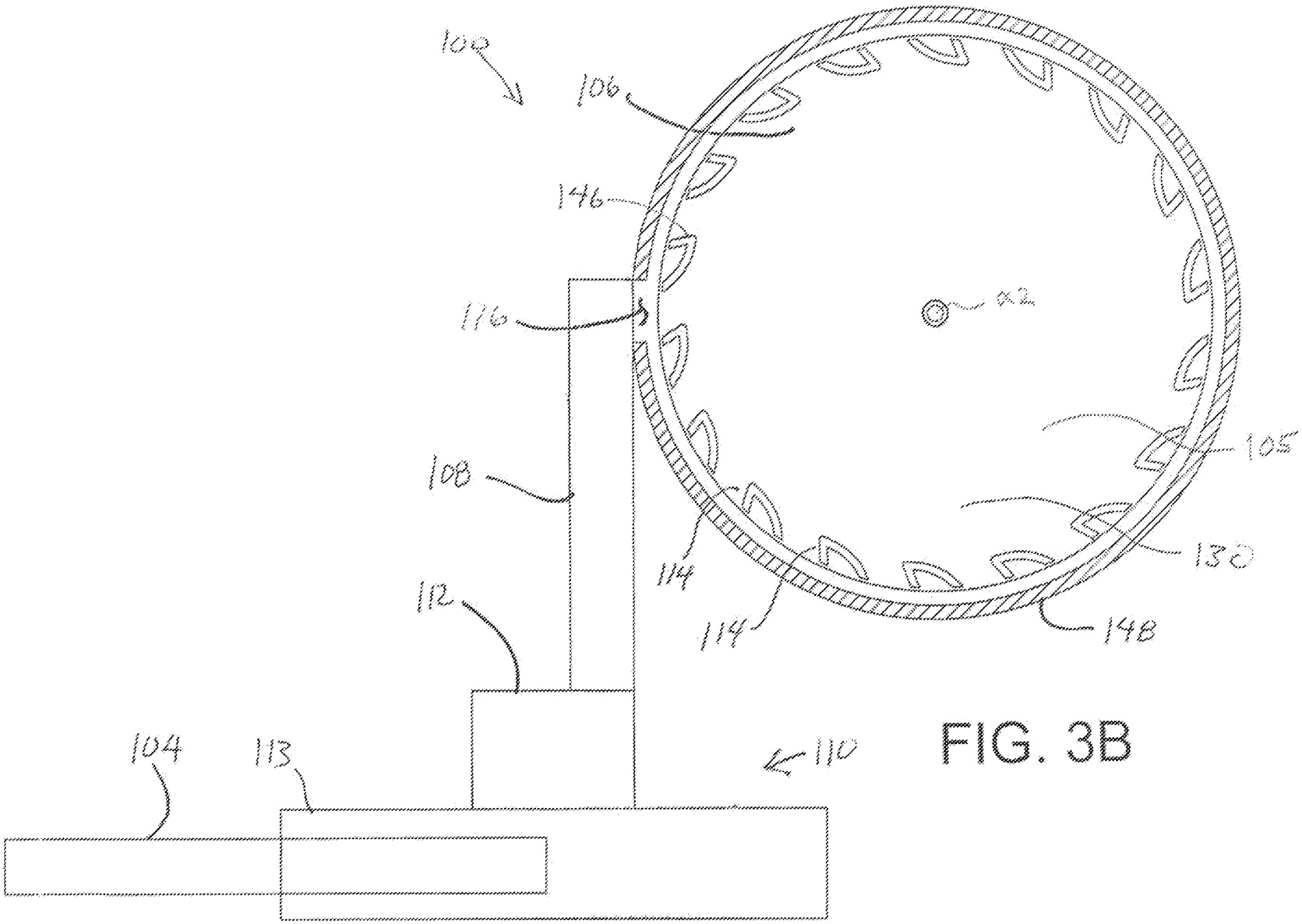
FIG. 3B is a diagrammatic elevation view showing principal component arrangement in accord with embodiments.
Figure 3C:
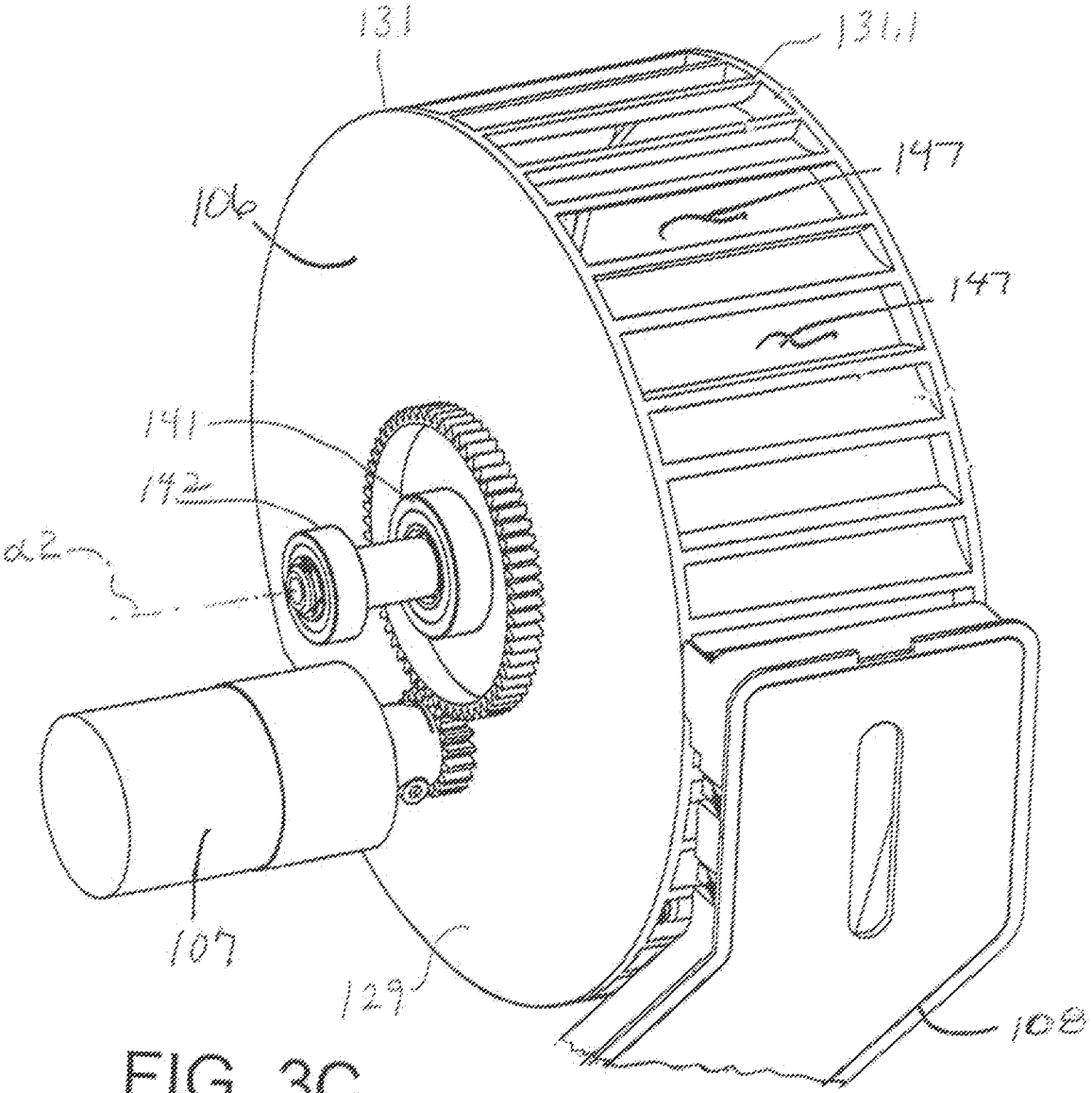
FIG. 3C is a perspective view illustrating a drive system for the lifting wheel in accord with embodiments.

Referring to FIGS. 2A, 2B, and 3A, the cartridge receiving region 105 may be defined by the interior of the wheel defined by the wheel circular plate 129, the peripheral ring structure, and the housing 140 including a wheel cover with a hopper 154. The wheel cover can protrude outwardly as shown in FIG. 3A providing a receiving region with greater capacity.

The lifting wheel 106 supported by the chassis or housing 140 such as by bearings 141, 142 that seat into cooperating recess structure 144 of the chassis or housing 140. The motor 107 may attach to motor support structure 145 also on the chassis or housing 140. See specifically FIGS. 3A and 3C.

The individual cartridges 102 are lifted to an elevated discharge region 116 in or supported by the chassis and/or housing 140. The discharge region 116 may be configured as a window and slot in the cylindrical wall portion 148. The cartridges 102 are transferred, one by one, through the discharge region 116 and into a gravity fed passageway 118 defined by the chute 108. The chute 108 generally having a passageway thickness slightly greater than a maximum diameter of the cartridges 102.

The cartridges, before being inserted into the magazine need to be directionally oriented by orientation means to all be facing the same way.

Figure 4A:
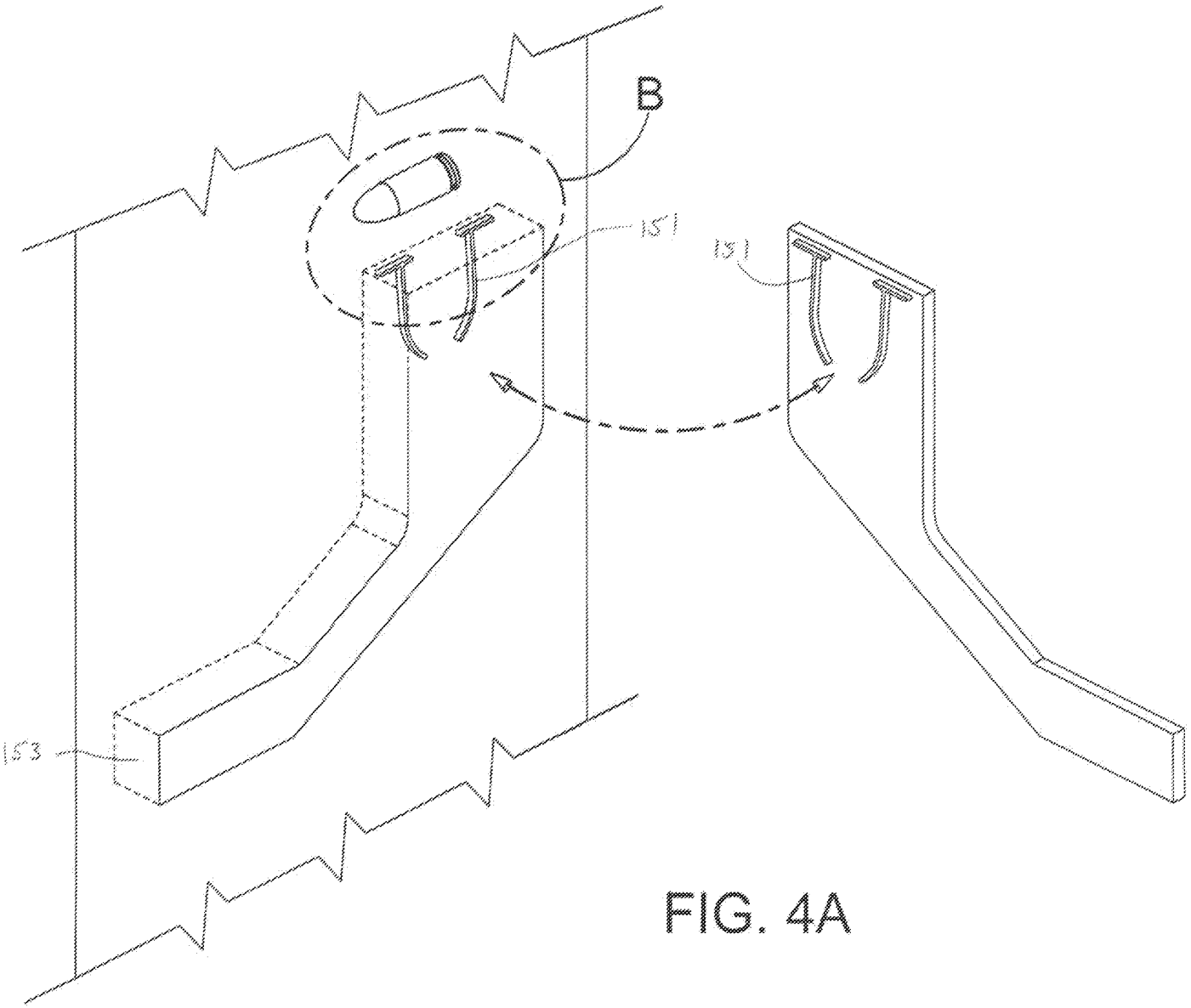
FIG. 4A is a partial perspective exploded view showing a chute of a cartridge transfer portion in accord with embodiments.
Figure 4B:
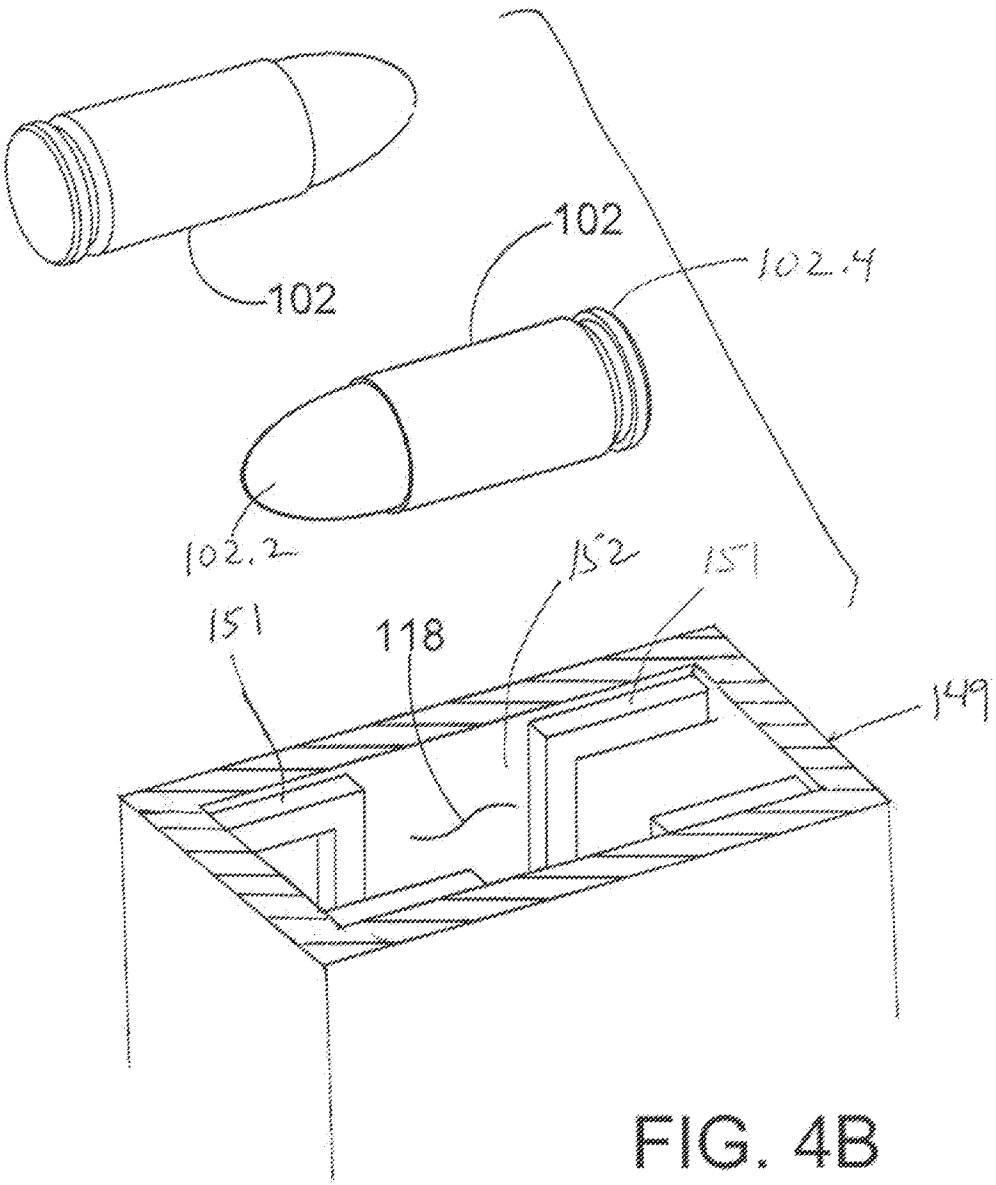
FIG. 4B is an enlarged sectional detail view further illustrating one cartridge directional orienting means and cartridges suitable for handguns comprising a chute.
Figure 7B:
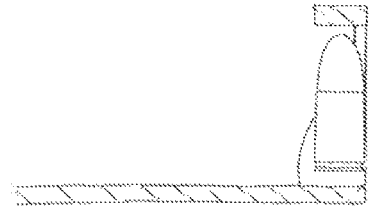
FIG. 7B is a cross sectional view of the cartridge in the lifting pocket of FIG. 7A at a raised position with the cartridge being maintained in the lifting pocket in the desired directional orientation.
Figure 7A:
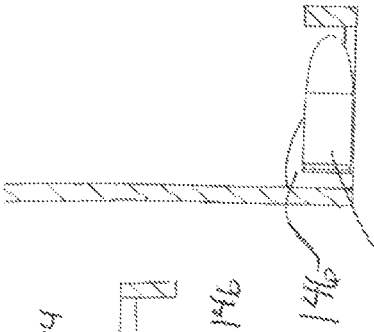
FIG. 7A is a cross sectional view of the lifting wheel of FIGS. 5 and 6 holding a cartridge in a lifting pocket in a desired directional orientation.
Figure 6:
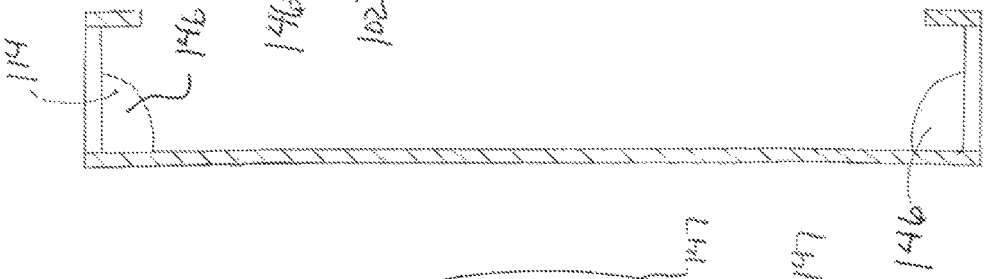
FIG. 6 is a cross sectional view of the lifting wheel of FIG. 5 illustrating the shelves configured for lifting cartridges in one of two directional orientations.
Figure 5:
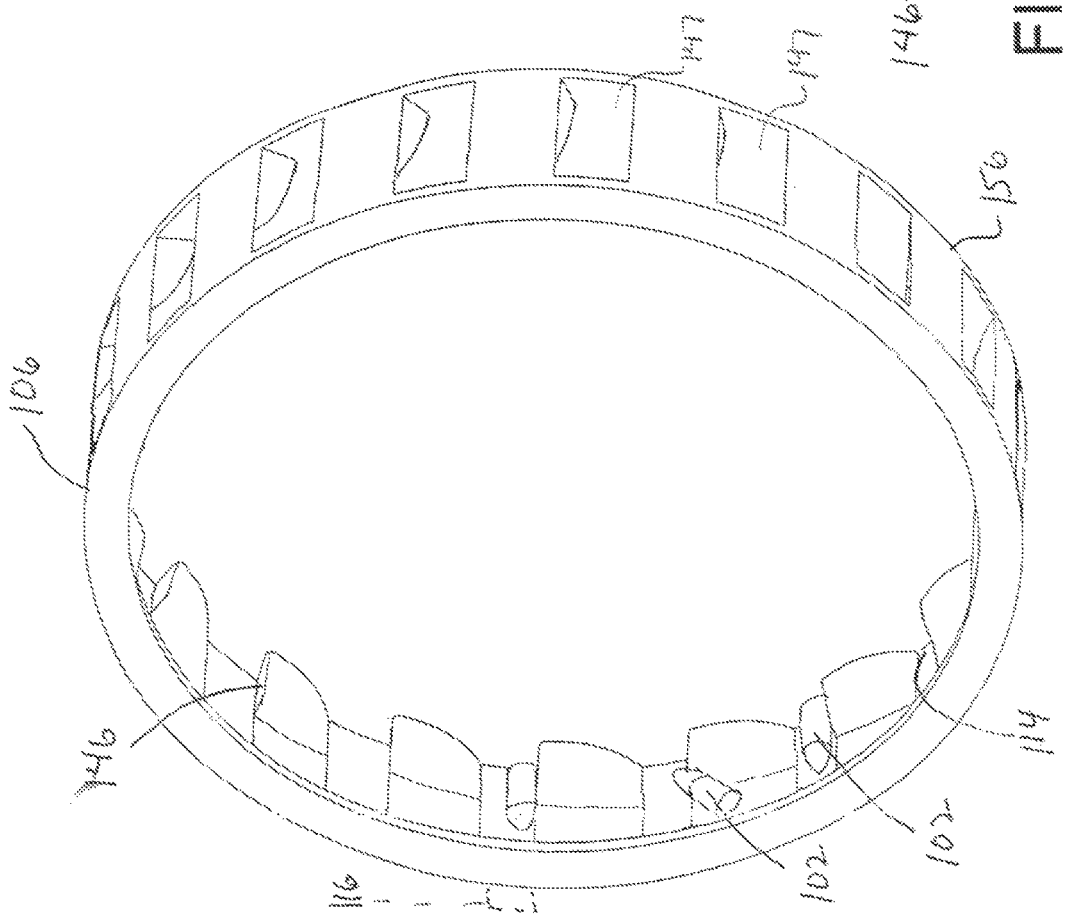
FIG. 5 is a lifting wheel in accord with embodiments suitable for cartridges with aspect ratios suitable for handguns.
Figure 10:
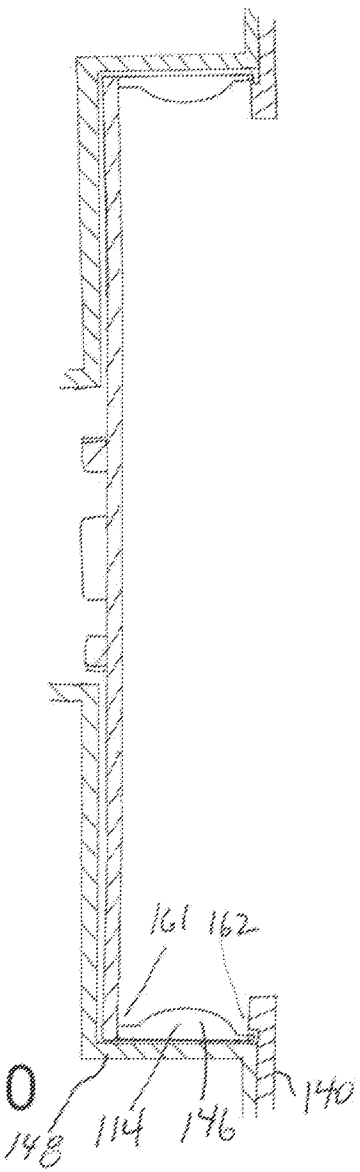
FIG. 10 is a cross sectional view of the wheel of FIG. 9 in place in a housing.
Figure 9:
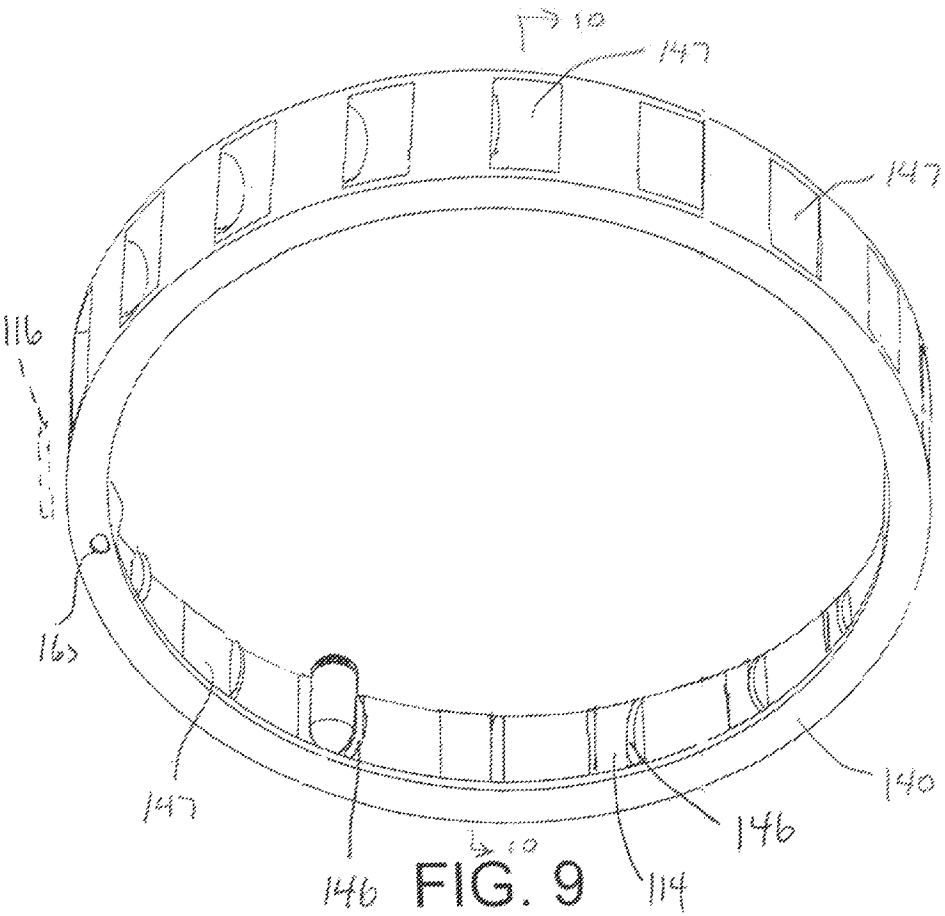
FIG. 9 is a perspective view of another lifting wheel embodiment which will support the cartridges in either of two directional orientations with stationary ring fixed with respect to the housing that does not rotate with the lifting wheel and that supports a deflector.
Figure 16A:
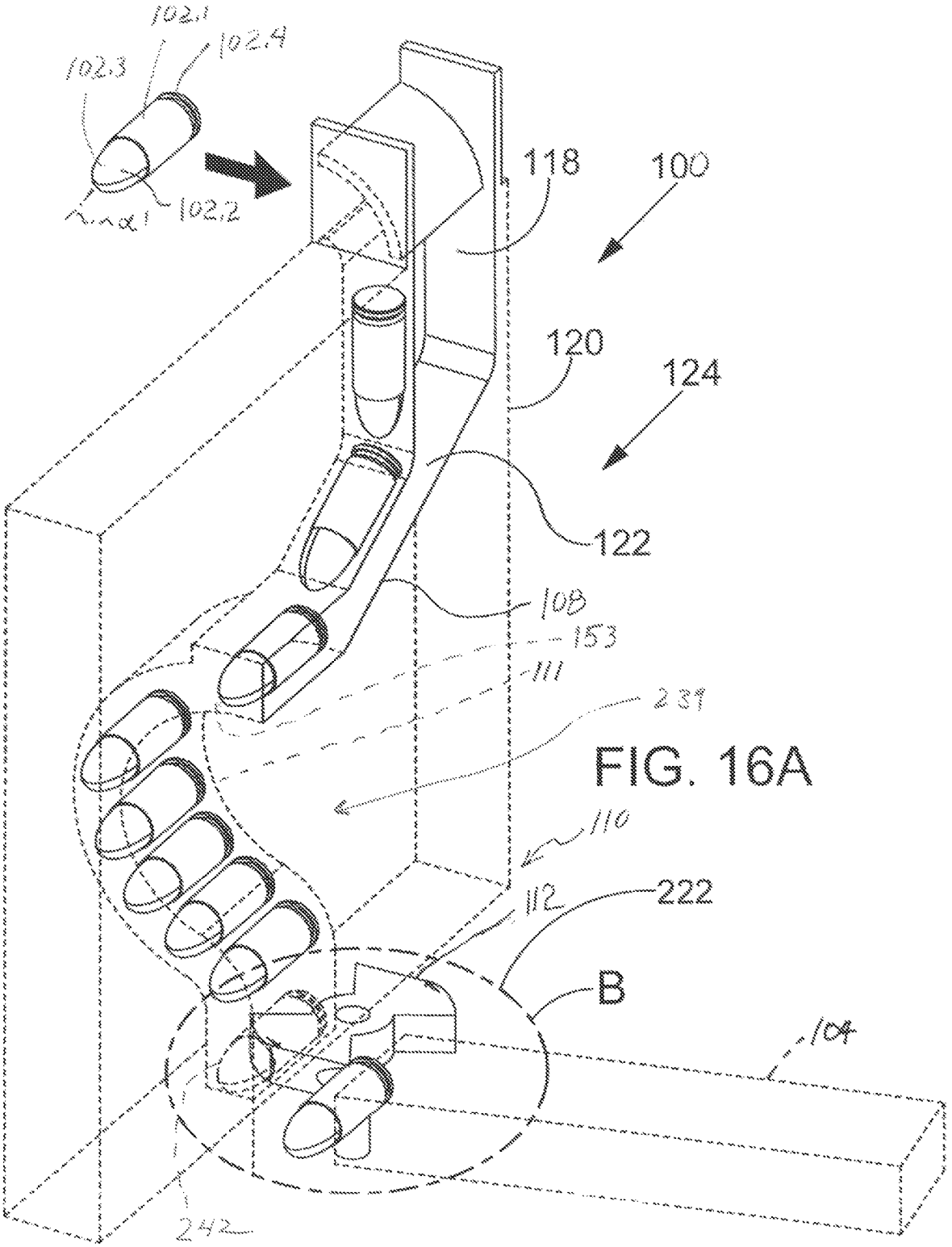
FIG. 16A is a diagrammatic perspective view showing a chute of a magazine loader with a C-shaped chute extending to a magazine loading portion.

Referring to FIGS. 4A, 4B, and 16A one cartridge direction orientation means is provided by the chute 108 having an upper portion 149 with opposing restrictive structures 151, such as ribs, narrowing the thickness of the passageway 118 of the chute on each of two sides of the chute, but not in a middle portion 152 of the upper portion. The restrictive structure 151 sized to allow the forward end 102.2 of the cartridge, due to the reduced diameter of the forward end, to fall downward but prevents the rearward end 102.4 of the cartridge to pass through the restrictive structures 230 due to increased diameter of the rearward portion. As the forward end falls the cartridge rotates such that the rearward end is upwardly from the forward end and the rearward end becomes more centered in the upper portion where there is no restrictive structure, allowing the cartridge to fall, forward end or tip end first. The shape of the chute then narrows and sweeps to a horizontal direction forcing each cartridge to rotate as the cartridge travels down the chute to a horizontal orientation. An upright stop portion 153 of the chute stops lateral motion and allow the horizontal cartridges to then be transferred downwardly in a direction transverse to their lengthwise axis. The restrictive structures 151 may extend downwardly on the interior surfaces of the chute as shown in FIG. 4A for further constraining and orienting the cartridge in the proper orientation.

Referring to FIGS. 5-14, alternate cartridge directional orientation means are illustrated utilizing structure associated with the lifting wheel 106. Referring specifically to FIGS. 5-8B, each of the shelves may be configured to allow the lifting of the cartridges all the way to the discharge region 116 in only one of the two directional orientations. For example, the shelf 146 can extend inwardly from the wheel periphery 156 at a proximal end 157 of the pocket 114 but be muted or missing at a distal end 159 of the pocket. Such a configuration allows the shelf 146 to adequately support and lift the cartridge when the cartridge is oriented in a desired or proper directional orientation as shown in FIGS. 7A and 7B, but when the cartridge is in an undesired orientation of FIGS. 8A and 8B, the cartridge falls out of the pocket before the pocket and cartridge reach the discharge region 116 to the cartridge receiving region where the cartridge is again lifted, and the cycle repeated, until the cartridge is in the proper directional orientation.

Referring to FIGS. 9-14, another means for directionally orienting the cartridge associated with the lifting wheel is depicted. The lifting wheel 106 has a shelf 146 that is configured to lift the cartridges in either orientation, such as a shelf centrally positioned intermediate the proximal and distal margins 161, 162 of the pocket 114. A deflector 163 extends into the pocket 114, for example the distal end 159 of the pocket and is fixed with respect to the chassis and the cylindrical wall portion 148 and is position below the discharge region 116. The deflector 163 positioned such that when the projectile end 102.2 of the cartridge 102 is at the distal end 159 the deflector does not engage the cartridge due to the taper of the projectile, see FIGS. 11 and 12. When the casing end 102.4 of the cartridge 102 is positioned in the distal end of the pocket, the deflector engages the cartridge as it is being raised by the lifting wheel and the deflector 163 ejects the cartridge from the pocket 114 before the cartridge reaches the discharge region 116, see FIGS. 13 and 14. The deflector may be configured as a screw to be adjustable.

Figure 8B:
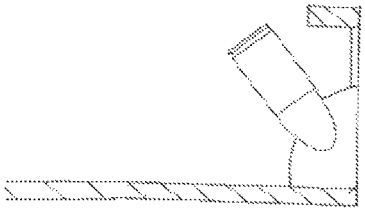
FIG. 8B is a cross sectional view of the cartridge in the lifting pocket of FIG. 8A at a raised position with the cartridge being discharged from the lifting pocket so that it is not deposited in a discharge region to the chute.
Figure 8A:
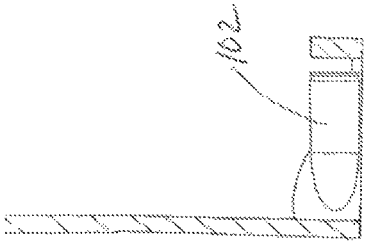
FIG. 8A is a cross sectional view of the lifting wheel of FIGS. 5 and 6 holding a cartridge in a lifting pocket in an undesired directional orientation.
Figure 8C:
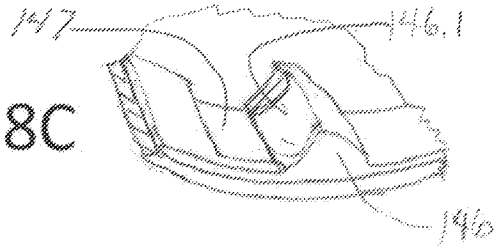
FIG. 8C shows lifting wheel shelf structure that allows seating of a cartridge only when in a proper directional orientation.
Figures 11, 12, 13, 14:
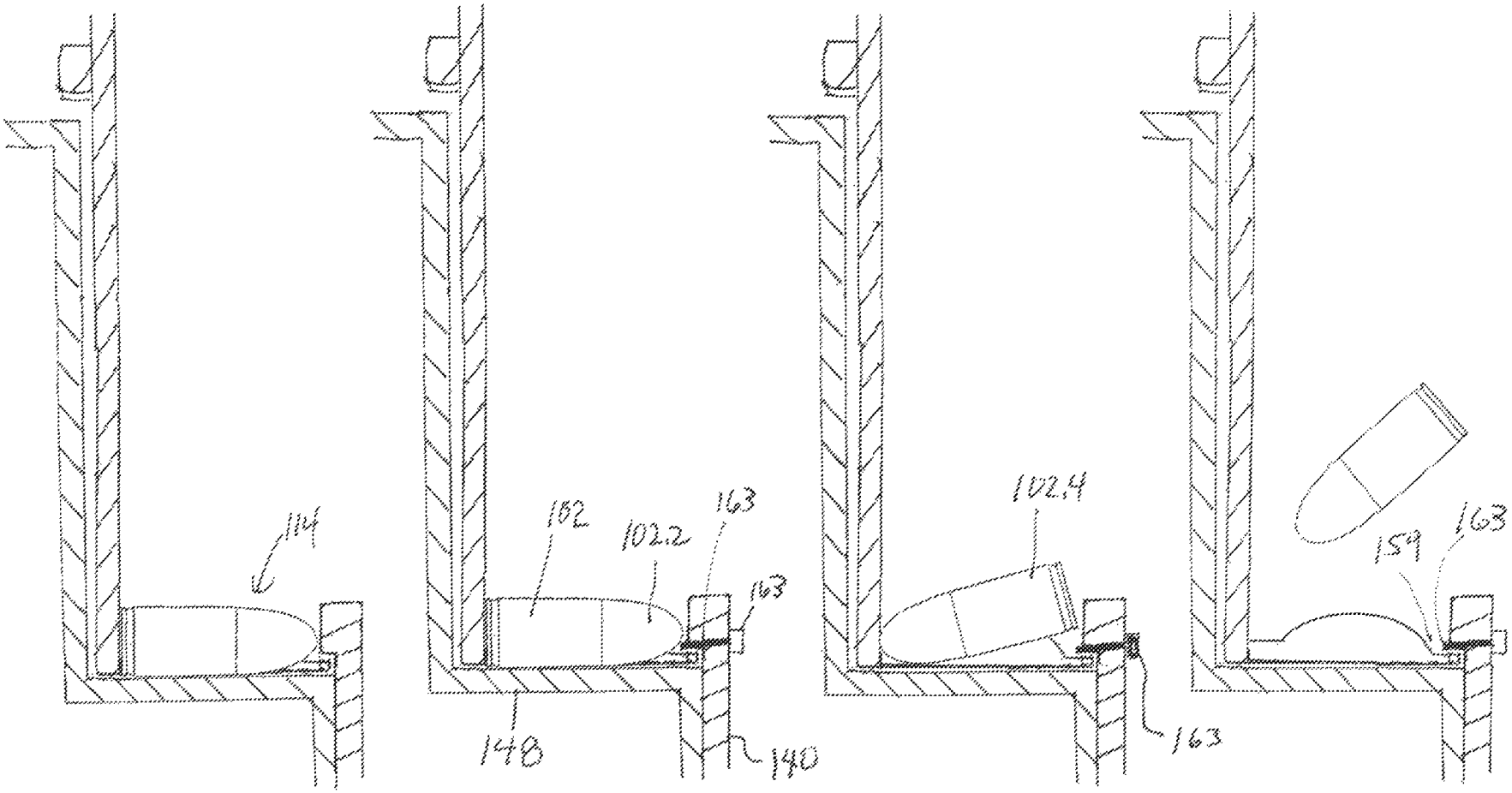
FIG. 11 is a cross sectional view of the wheel of FIGS. 9 and 10 with a cartridge being lifted by the shelf.
FIG. 12 is a cross sectional view of the wheel of FIGS. 9 and 10 with a deflector positioned that does not interfere with the projectile end of the cartridge being lifted by the lifting wheel.
FIG. 13 is a cross sectional view of the wheel of FIG. 12 with the deflector deflecting a cartridge with the casing end of the cartridge at the deflector end.
FIG. 14 is a cross sectional view of the wheel of FIG. 13 with cartridge being separated from the lifting pocket.
Figure 15A:
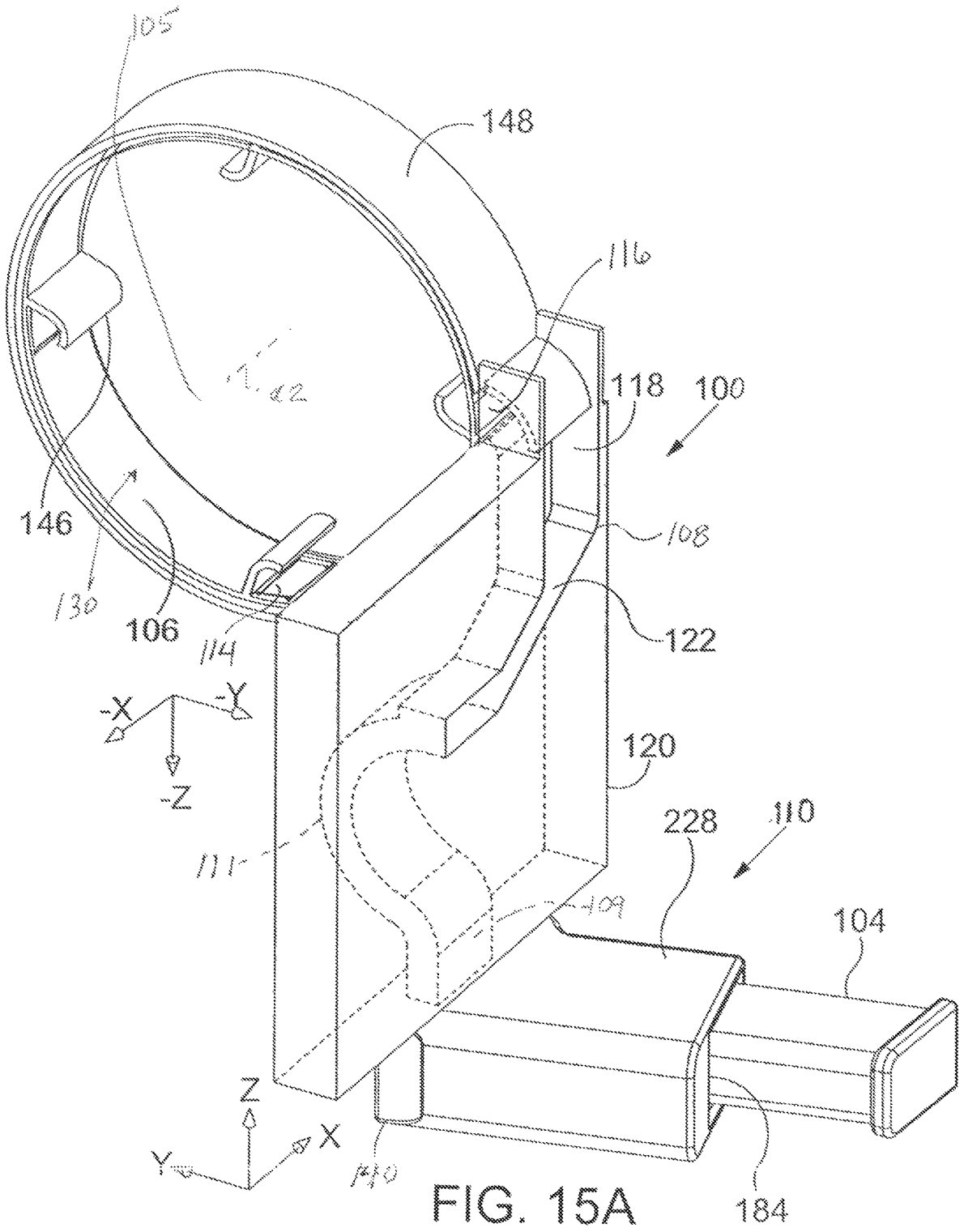
FIG. 15A is perspective view showing a wheel assembly of the magazine loader shown in FIGS. 3A and 3B.
Figure 15B:
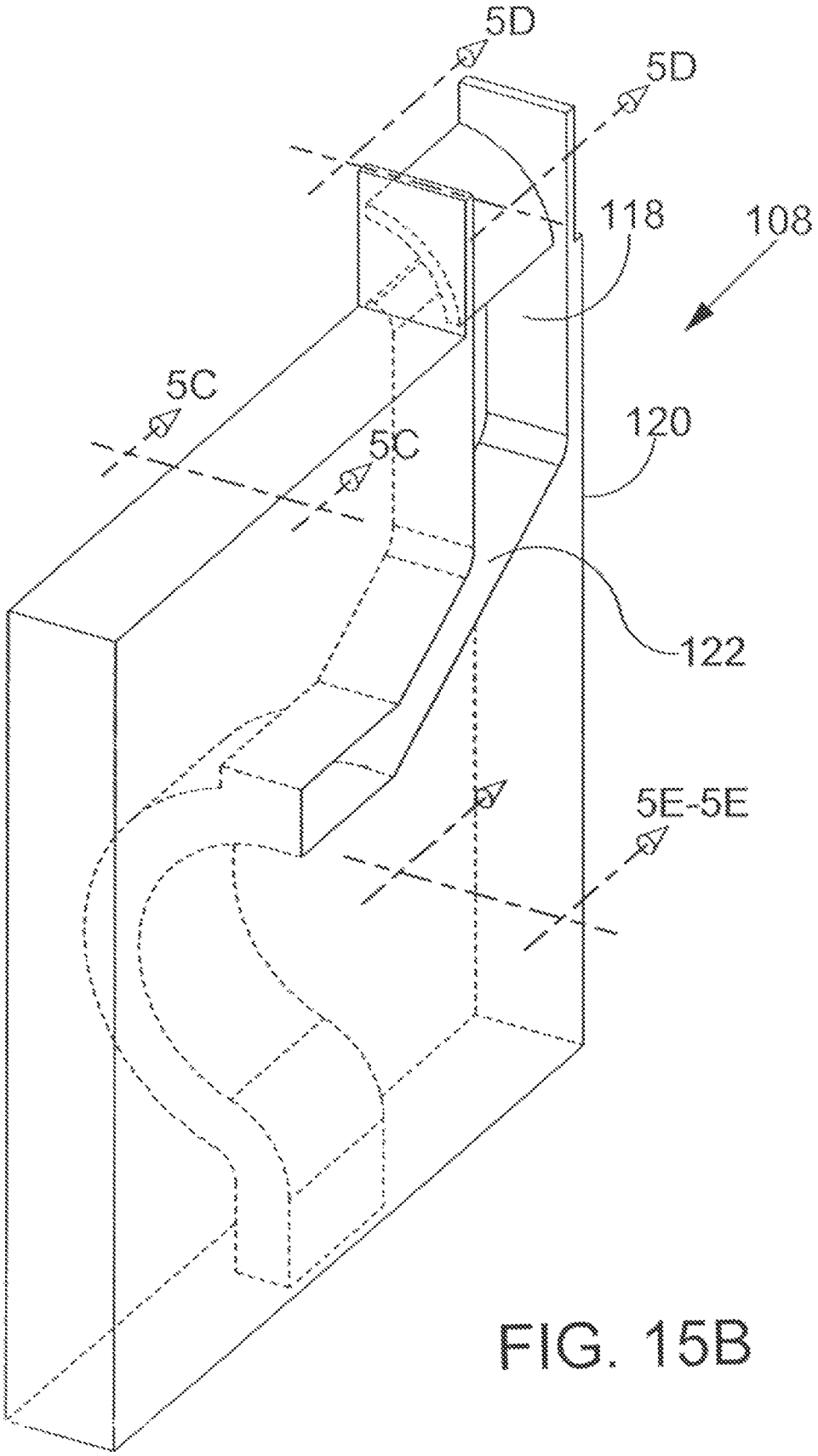
FIG. 15B is perspective view showing a chute member of the magazine loader sub-assembly shown in FIG. 15A.
Figure 15C:
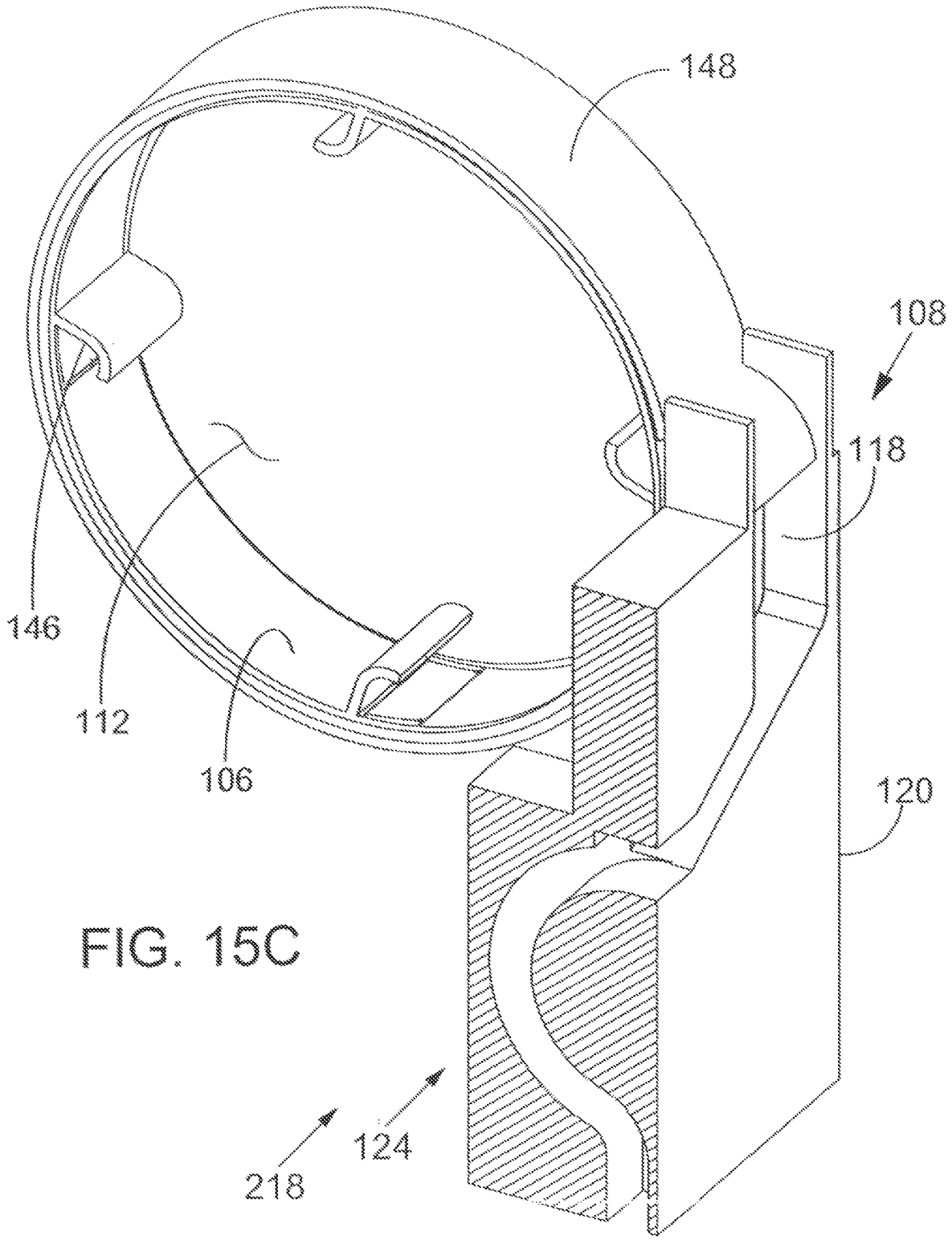
FIG. 15C is a cross-sectional view of the chute member shown in FIG. 15B. In the embodiment of FIG. 15C, the device has been sectioned along section line 15C-15C shown in FIG. 15B.
Figure 15D:
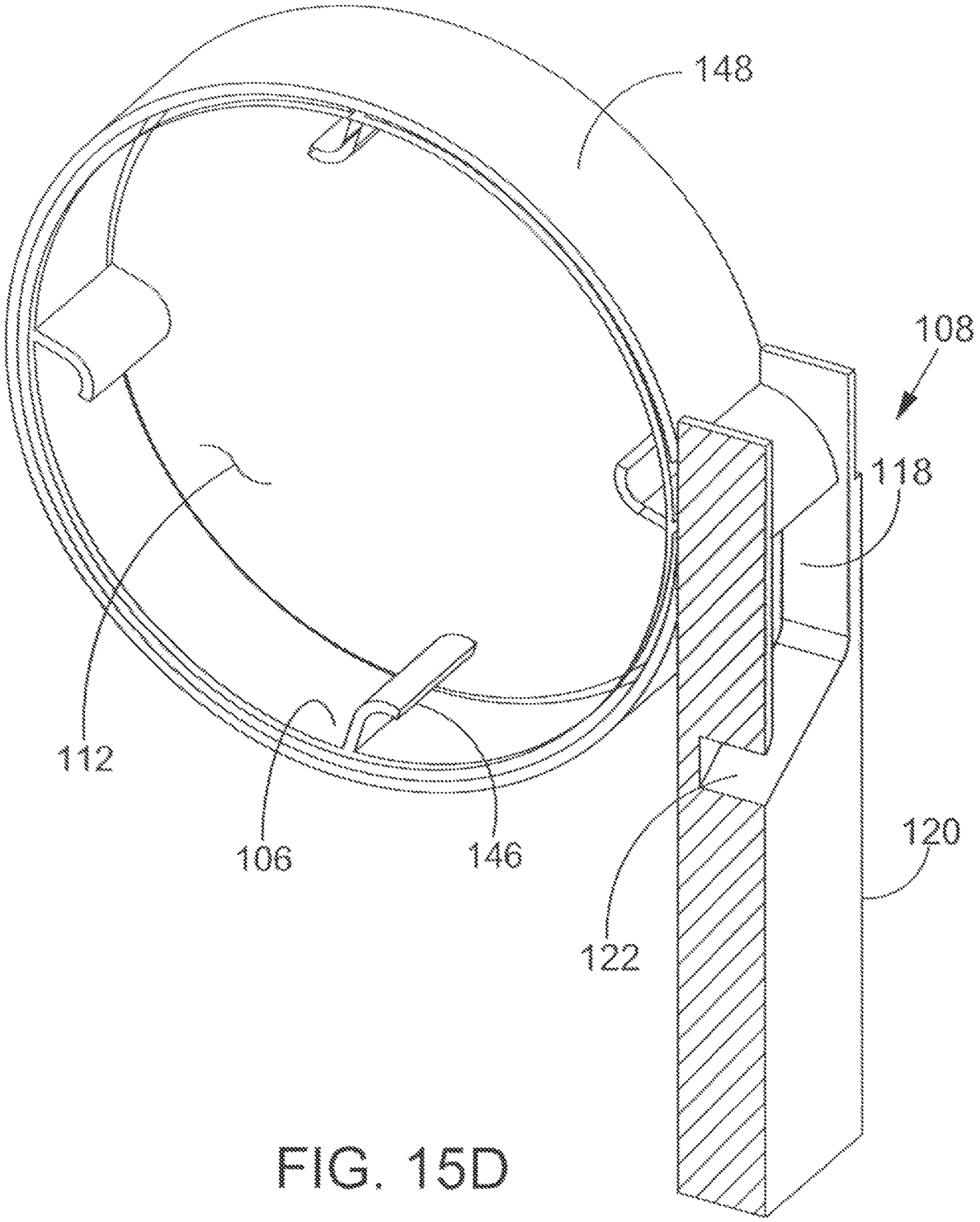
FIG. 15D is a cross-sectional view of the chute member shown in FIG. 15B. In the embodiment of FIG. 5D, the device has been sectioned along section line 15D-15D shown in FIG. 15B.
Figure 15E:
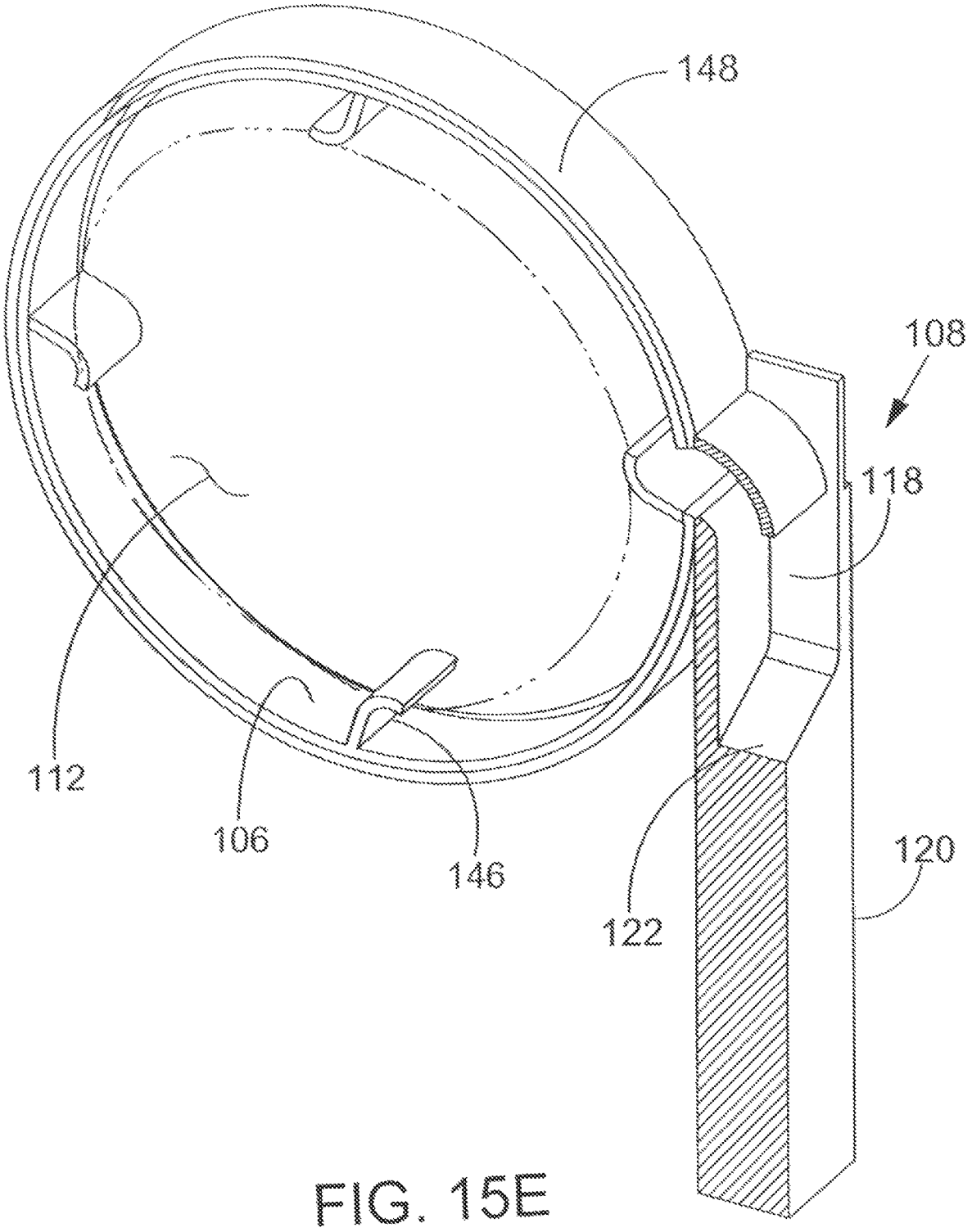
FIG. 15E is a cross-sectional view of the chute member shown in FIG. 15B. In the embodiment of FIG. 15E, the device has been sectioned along section line 15E-15E shown in FIG. 15B.
Figure 15G:
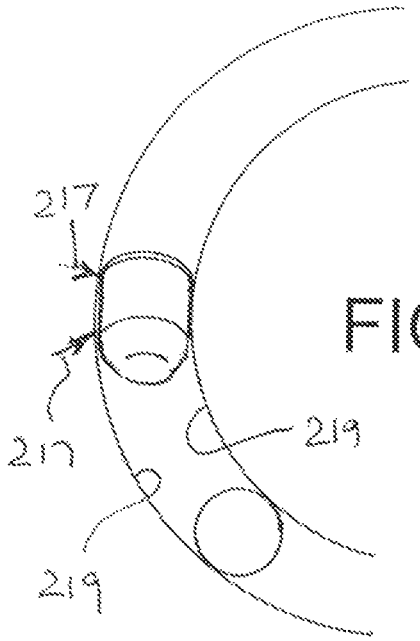
FIG. 15G is a diagrammatic end view of the passageway of the C-shaped chute of FIG. 15F showing the engagement points of the cartridge and chute precluding it from rotating about an axis transverse to the lengthwise axis of the cartridge.
Figure 15F:
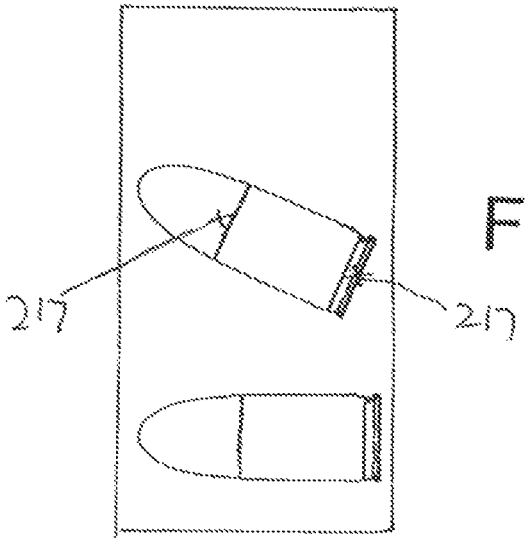
FIG. 15F is an elevational view of the C-shaped chute of FIGS. 15A-15C taken in front of the chute showing contact points of the bullet with the chute precluding the cartridge from rotating about an axis transverse to the lengthwise axis of the cartridge.

Referring to FIG. 8C, in embodiments, the shelf 146 may have structure 147 conformingly shaped to a particular cartridge shape such that the cartridge can only fully seat on the shelf if it is oriented in the desired directional orientation. That is a pocket conformingly shaped to the cartridge. Raising a cartridge toward the discharge region 116 at, for example, the 9 o'clock position, the unseated cartridge will fall out of the shelf at the 8 o'clock position back into the cartridge receiving region 105, while a fully seated cartridge with continue to the 9 o'clock position to be discharged through the discharge region 116.

Referring to FIGS. 15A to 16A, the cartridges that are deposited to the discharge region 116 enter the transfer portion 108 configured as a chute. In embodiments, particularly those configured for handgun cartridges, the chute, rather than having a vertical portion where the cartridges essentially free fall to the magazine loading portion and where then could rotate/flip from a desired horizontal directional orientation to the opposite undesired directional orientation precluding insertion of the cartridges into the magazine, has a curved portion 218 that may be utilized to maintain the cartridges in their desired directional orientation as they are transferred to the magazine loading portion 110. Utilizing a curved C-shaped chute portion 218, the curvature having an axis parallel to the lengthwise axis of the cartridges 102 precludes the cartridges from rotating other than about the cartridges' lengthwise axis. That is, the cartridges 102 may roll down the C-shaped chute portion 218 but cannot flip to a different opposite directional orientation. As illustrated in FIGS. 15F and 15G, in embodiments, the curvature limits rotation by the contact points 217 on the chute wall surfaces 219 as there is not room for the cartridge to rotate angularly from the horizontal orientation. The C-shaped chute portion 218 along with a short vertically straight portion therebelow may form an accumulator portion 124 of the chute 108 where cartridges can be stacked before being inserted into a magazine. In embodiments, the accumulator portion 124 has a singular exit slot positioned located such that it is at the bottom of any cartridges stacked in the accumulator portion. A series of single cartridges is fed, one by one, through the singular exit slot and into a cartridge receiving region 216 of a cartridge setting mechanism 220.

Figure 16B:
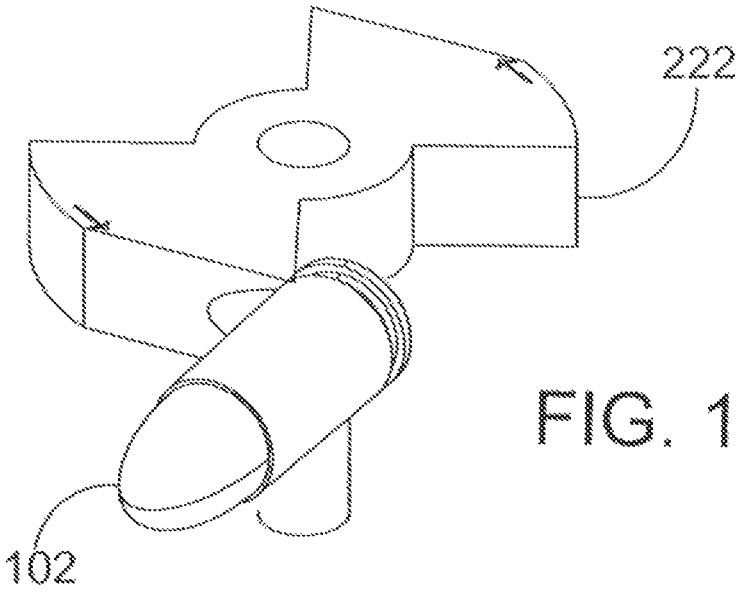
FIG. 16B is an enlarged detail view further illustrating a rotating wheel of the magazine loading mechanisms shown in FIG. 16A engaging a cartridge.
Figure 16C:
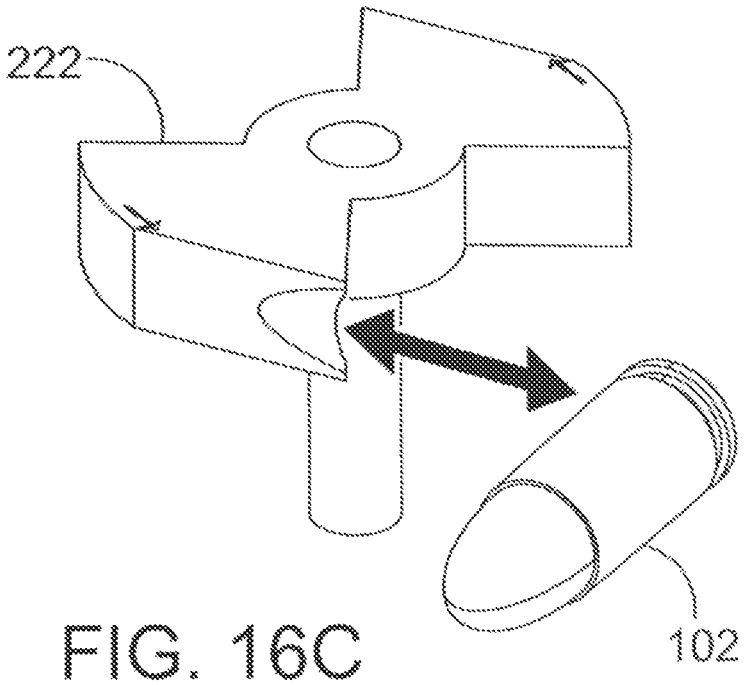
FIG. 16C shows an engagement feature of the rotating wheel of FIG. 16B with a cartridge.
Figure 17C:
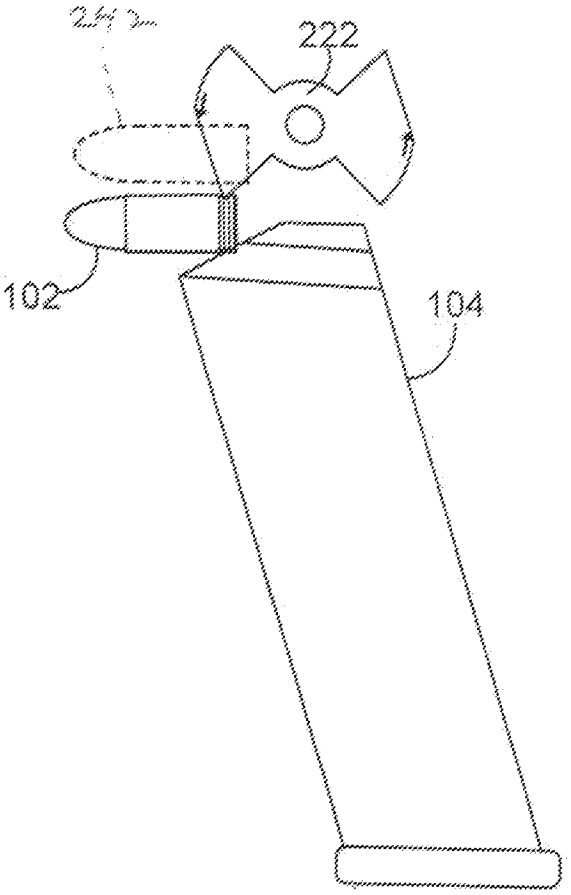
FIGS. 17A through 17I are a sequence of stylized diagram showing a cartridge being urged to translate and slide into a magazine by a rotating setting tool in accordance with the detailed description.
Figure 17B:
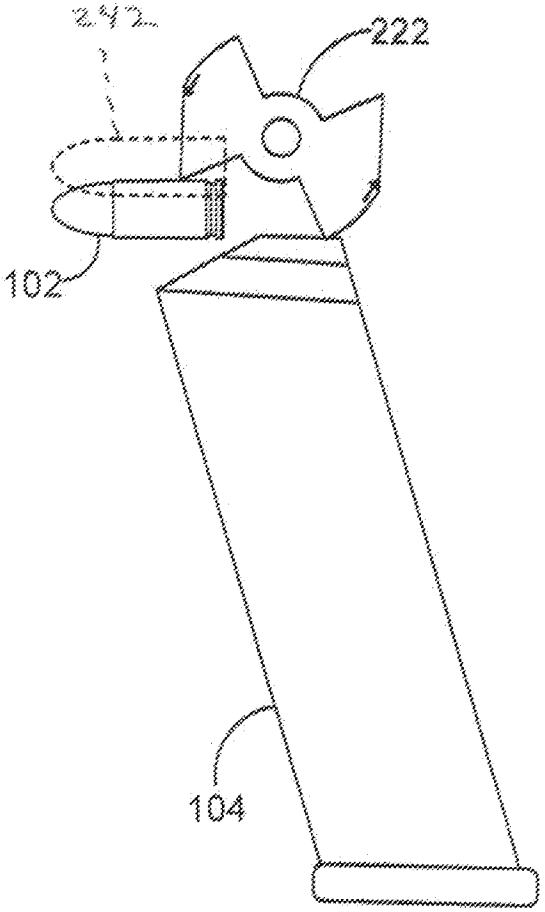
Figure 17A:
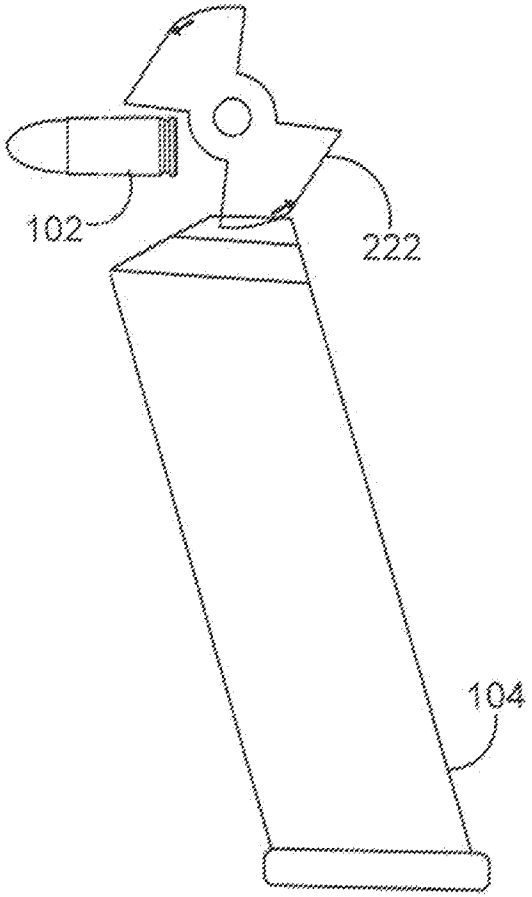
Figure 17F:
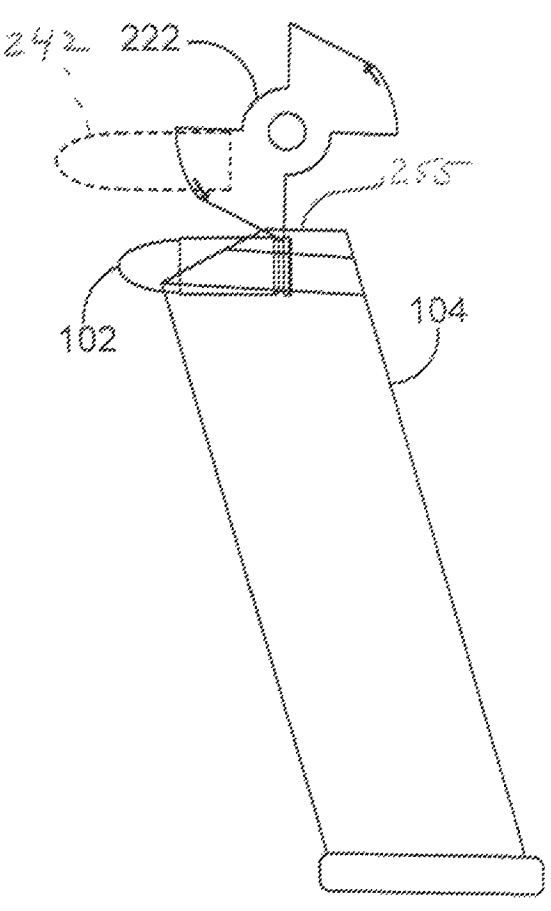
Figure 17E:
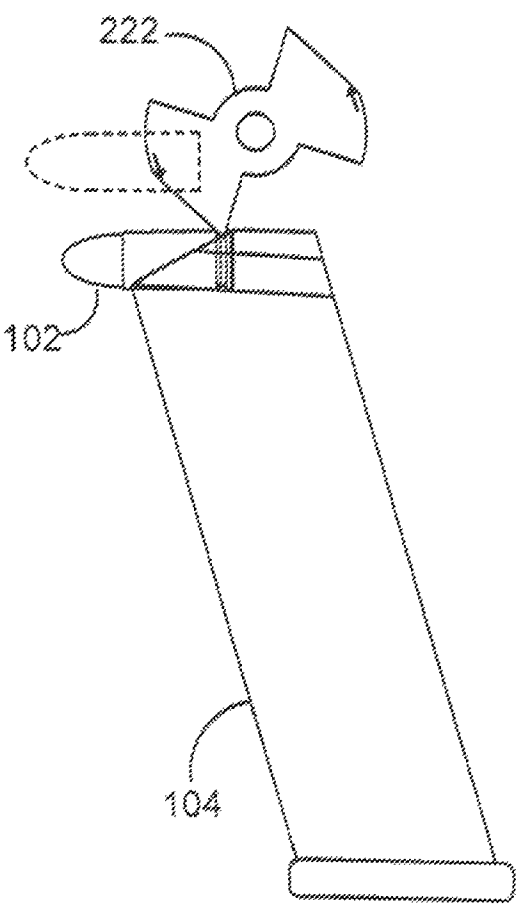
Figure 17D:
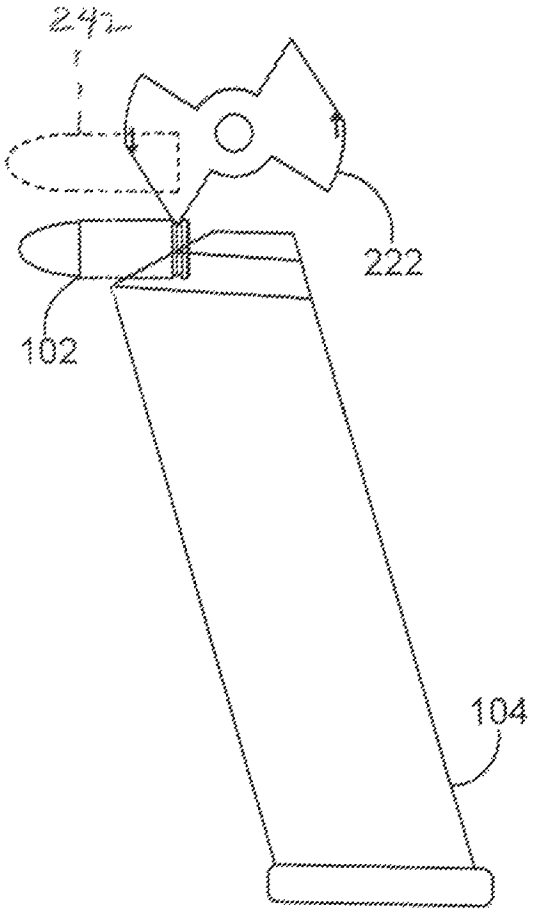
Figure 17I:
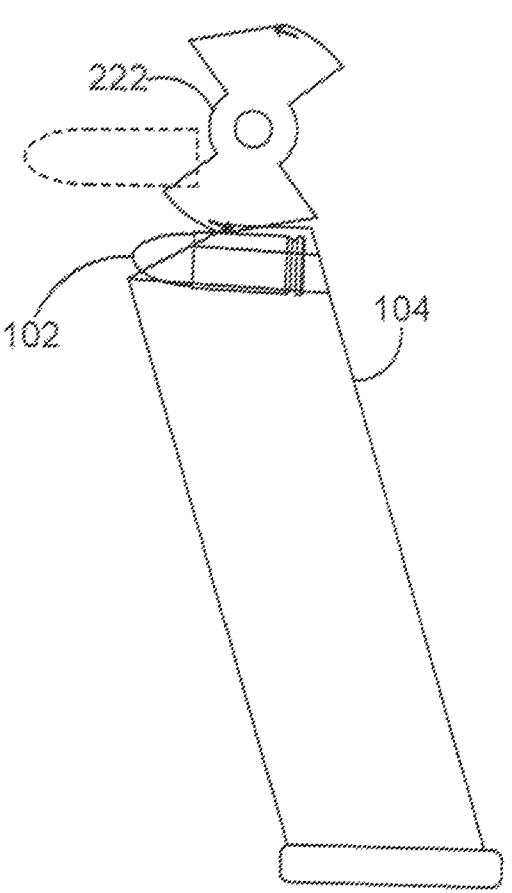
Figure 17H:
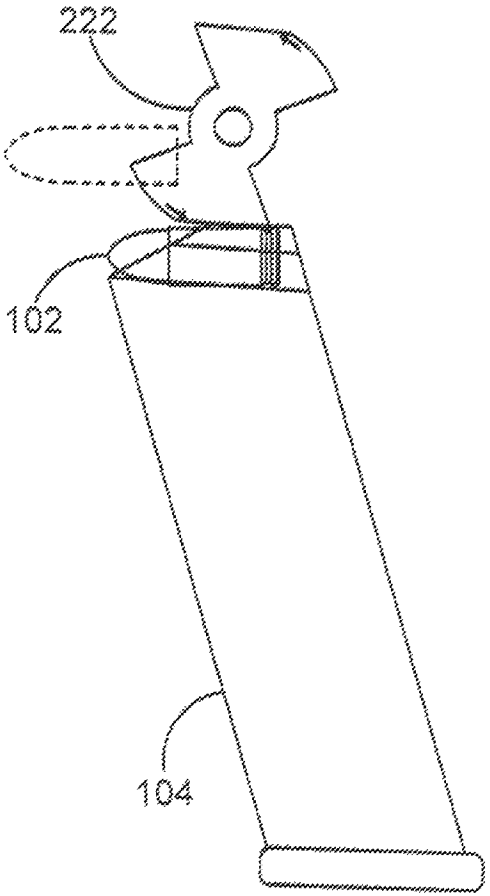
Figure 17G:
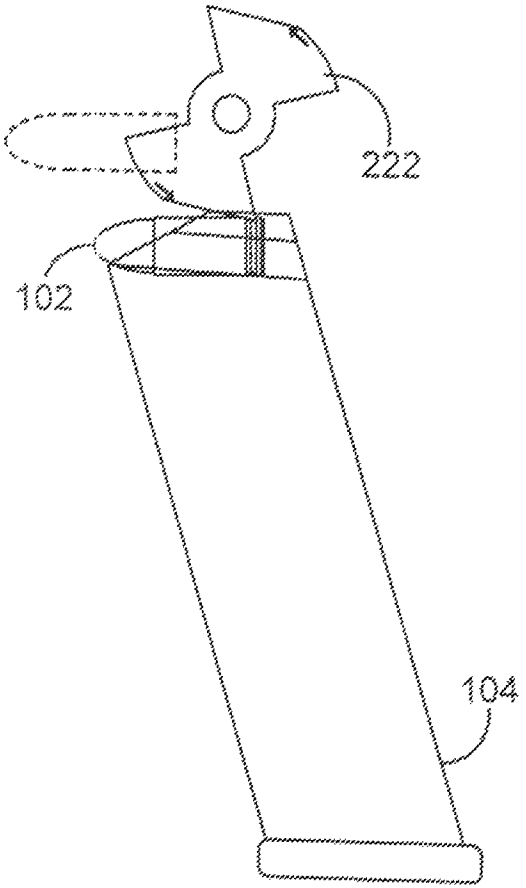

Referring to FIGS. 15A, 16A through 17I, in embodiments, the magazine loading portion 110 has a cartridge setting mechanism 220 with a setting tool 222 configured as a rotating setting wheel and a setting motor 232 operatively coupled to the setting tool 222 by a gear box 234 so that the setting tool rotates as suitable speed as the setting motor 232 is operated. In embodiments, the cartridge setting mechanism 220 may comprise a setting mechanism housing 140 that supports the setting tool 222. The setting tool configured as a rotating wheel has a central portion 233 with a pair of lobes 235 extending therefrom and defining cartridge receiving voids 237. The stack 239 of cartridges may rest on the top surface 241 of the setting tool when one of the two lobes is under the stack and accumulator portion of the chute, see specifically FIGS. 16A and 17B-17I, where the lowermost cartridge 242 is shown in dashed lines. In FIG. 17I the lowermost projectile is about to fall into the cartridge receiving void. FIG. 17A shows a cartridge in the cartridge receiving void 237. The lobe translates the cartridge toward the open mouth 245 of the magazine and a grasping edge 247 grabs the casing at the circumferential recess defining the rim 251 of the cartridge, see FIG. 17C, and then urges the cartridge into the magazine mouth and below the magazine upper enclosure portions 255 seating the cartridge therein. The grasping edge disengages the cartridge and continues its rotation as shown in FIG. 17I.

In embodiments, the setting tool may have more than two lobes, for example, three or four, with the cartridge receiving voids positioned intermediate each adjacent pair of lobes. In embodiments, other mechanisms may be utilized to insert the cartridges into the magazine, such as a reciprocating push mechanism.

In embodiments, the magazine loading portion has a setting mechanism housing 140 comprises a magazine receiving portion 228 that defines a magazine receiving cavity 184. As the setting tool 222 rotates, a series of single cartridges 102 are feed, one by one, into a magazine 104 positioned in the magazine receiving cavity 184 defined by the magazine receiving portion 228 of the setting mechanism housing 140.

Figure 18:
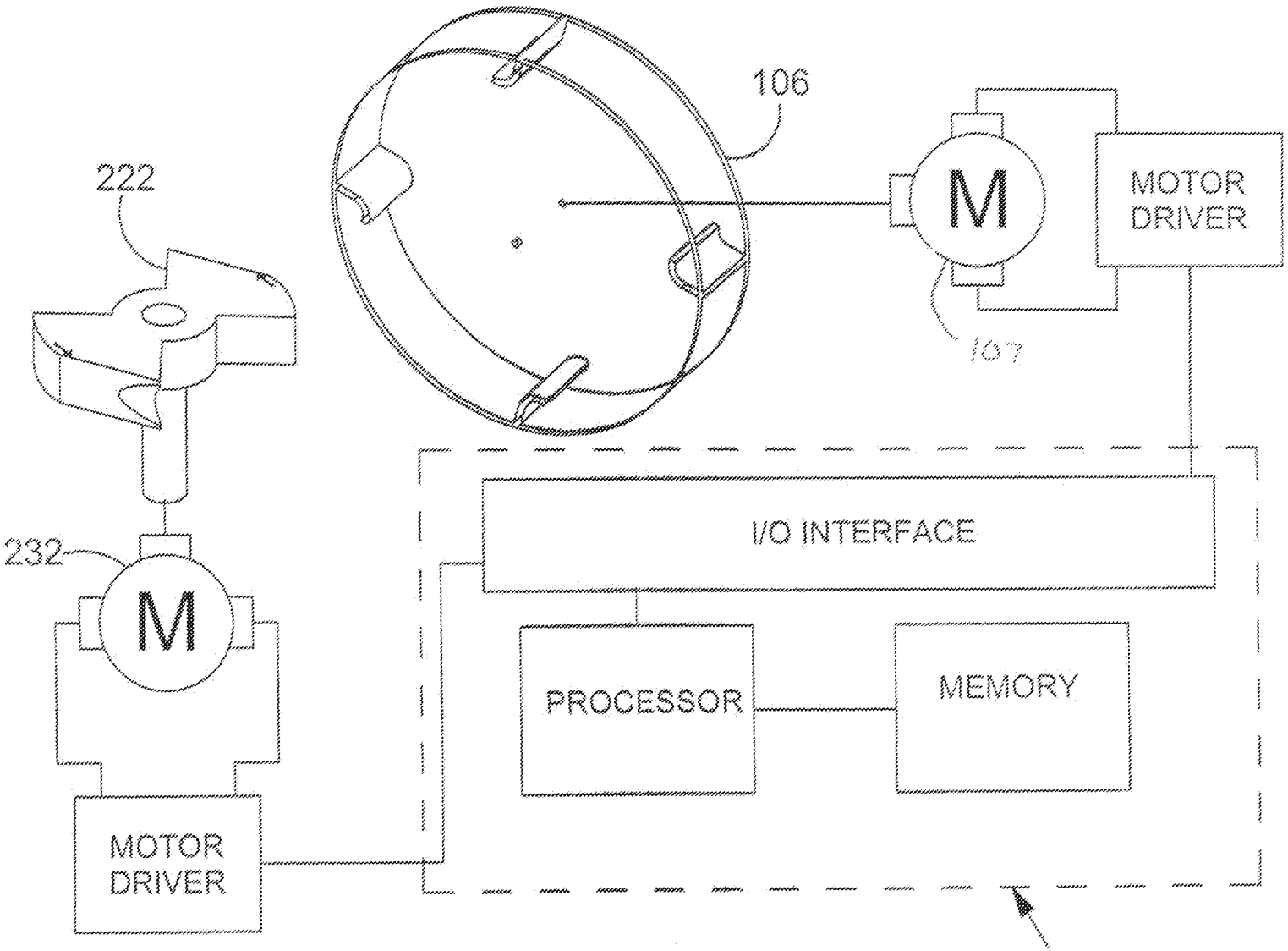
FIG. 18 is a diagrammatic/schematic view showing a magazine loader system.
Figure 19:
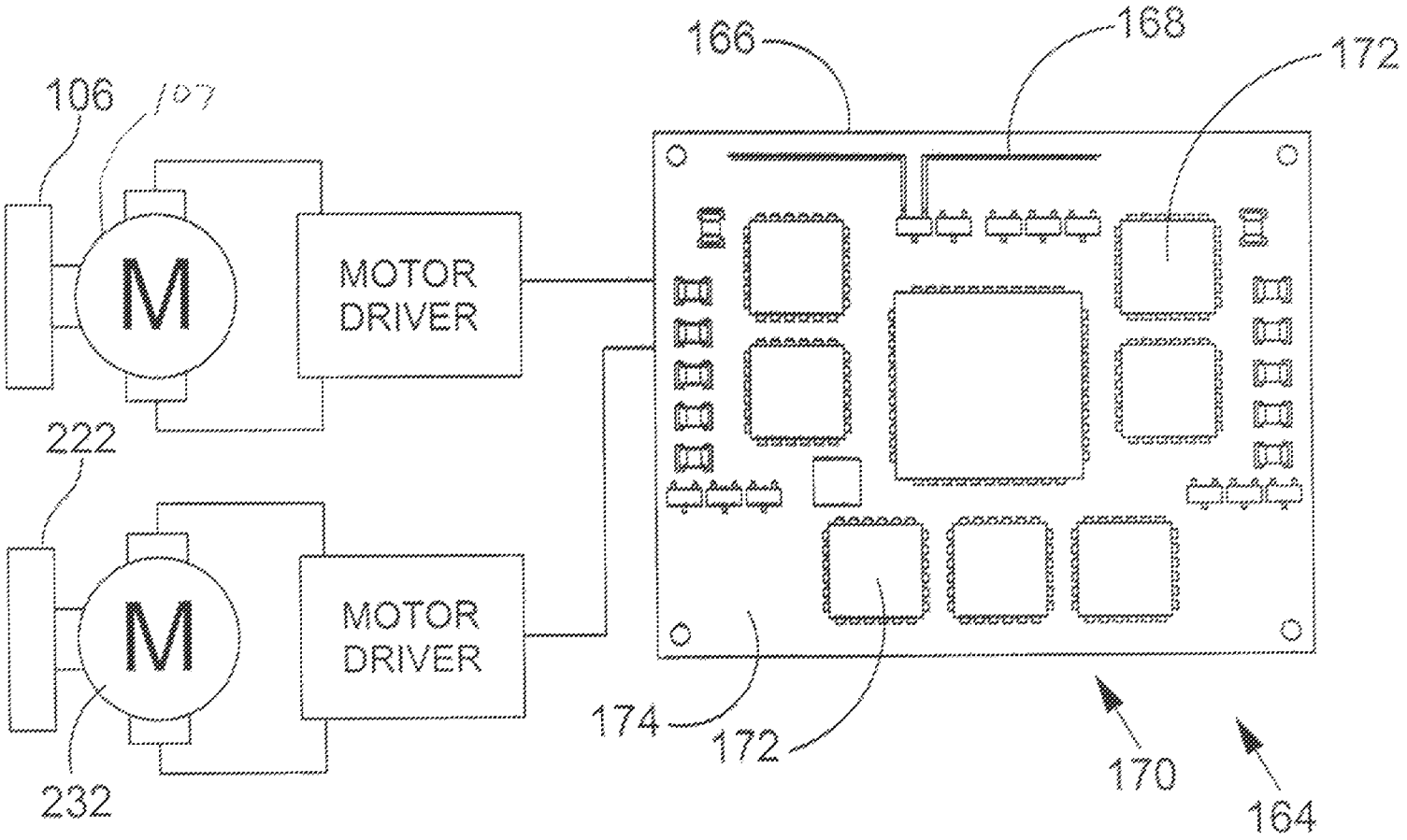
FIG. 19 is a diagrammatic/schematic showing a magazine loader system.
Figure 20:
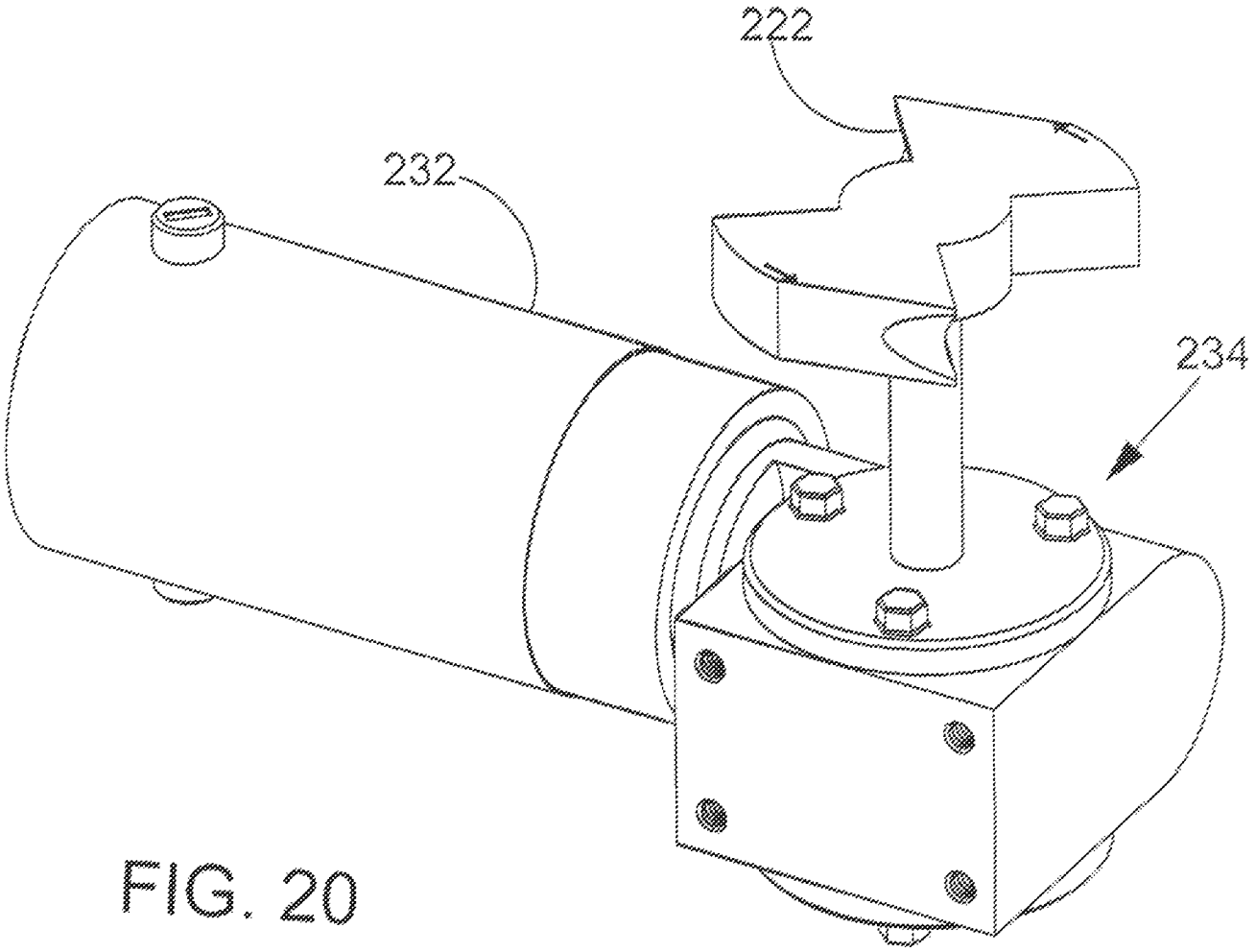
FIG. 20 is a perspective view of the rotating setting tool including a motor and setting wheel.

With reference to FIG. 18 and FIG. 19, it will be appreciated that the magazine loader 100 includes a printed wiring board 166 supporting the circuitry 164. In the embodiment of FIG. 16, the printed wiring board 166 comprises a substrate and the substrate supports a plurality of conductive paths 168 of the circuitry 164. The circuitry 164 comprises the printed wiring board 166 and a plurality of electronic components 172 that are electrically connected to the conductive paths of the printed wiring board 166. The plurality of electronic components 172 are mechanically fixed and/or electrically connected to the printed wiring board 166 to form a circuit card assembly 170.

Referring still to FIGS. 18 and 19, the circuitry 164 may comprise various elements without deviating from the spirit and scope of the present invention. For example, the circuitry may comprise combinational logic, a plurality of state machines and a clock that provides a clock signal to the combinational logic and the plurality of state machines. Each state machine may comprise state logic circuitry and a state memory. The state memory may comprise a plurality of memory elements such as flip-flops. The state logic circuitry of the state machine determines the conditions for changing the logical values of bits stored in the state memory. More particularly, the state logic circuitry of the state machine logically combines the binary values of a plurality of inputs with the binary values in the state memory representing the current state to generate a binary number representing the next state. The combinational logic circuitry may comprise various elements without deviating from the spirit and scope of the present description. For example, the combinational logic circuitry may comprise a plurality of discrete electronic components. By way of a second example, combinational logic circuitry may comprise a plurality of electronic components in the form of an application specific integrated circuit (ASIC). Examples of electronic components that may be suitable in some applications include logic gates. Examples of logic gates include, AND gates, NAND gates, OR gates, XOR gates, NOR gates, NOT gates, and the like. These logic gates may comprise a plurality of transistors (e.g., transistor-transistor logic (TTL)).

Referring to FIGS. 2A, 18 and 19, the circuitry 164 may comprise various control elements without deviating from the spirit and scope of the present invention. In embodiments, for example, the circuitry 164 may comprise a processor, a memory, an input/output interface, a display, and a bus that communicatively couples the processor to the memory, the display and the input/output interface. In an embodiment, the processor may comprise a collection of one or more logical cores or units for receiving and executing instructions or programs. For example, in embodiments, the processor may be configured to receive and execute various routines, programs, objects, components, logic, data structures, and so on to perform particular tasks. In an embodiment, the memory is a collection of various computer-readable media in the system architecture. In various embodiments, memory can include, but is not limited to volatile media, non-volatile media, removable media, and non-removable media. For example, in embodiments, the memory can include random access memory (RAM), cache memory, read only memory (ROM), flash memory, solid state memory, or other suitable type of memory. In embodiments, the memory includes media that is accessible to the electronic circuitry 164. For example, in some embodiments, the memory includes computer readable media located locally in the circuitry 164 and/or media located remotely to the circuitry 164 and accessible via a network. In some embodiments, the memory includes a program product having a group of one or more logical instructions that are executable by the processor to carry out the functions of the various embodiments of the disclosure. In an embodiment, the bus comprises one or more of any of suitable type of bus structures for communicatively connecting the electronic elements. In various embodiments the bus may include a memory bus or memory controller, a peripheral bus, and a processor or local bus using any of a variety of bus architectures. In some embodiments, the circuitry 164 includes an I/O interface coupled to a processor. The I/O interface may facilitate communication between the various components and the circuitry 164. For example, in embodiments, the I/O interface may be communicatively coupled with one or more sensors. In certain embodiments the I/O interface facilitates communication with input and output devices for interacting with a user. For example, the I/O interface may communicate with one or more devices such, as a user-input device and/or a visual display 180, which enable a user to interact directly with the circuitry 164. The user-input device may comprise a keyboard 176, one or more push buttons 178, a touch screen, or other devices that allows a user to input information. The visual display 180 may comprise any of a variety of visual displays, such as a viewable screen, a set of viewable symbols or numbers, and so on.

Referring to FIGS. 18 and 19, in embodiments, the electronic magazine loader includes circuitry 164 operatively coupled to the setting motor 232 and the motor 107 of a wheel drive system, wherein the circuitry comprises one or more processors and a non-transitory computer readable medium storing one or more instruction sets. In embodiments, the one or more instruction sets include instructions configured to be executed by the one or more processors to cause the magazine loader to rotate the wheel 106 while raising them one by one to the discharge region where the cartridges 102 are transferred, one by one, into the transfer portion 108 and to the magazine loading portion 110, so that the series of single cartridges are feed, one by one, into the magazine 104 positioned in the magazine receiving cavity 184 defined by the magazine receiving portion 228.

Particular embodiments may be suitable for handgun cartridges. In some embodiments, the length of the cartridge is about 1.135 inches to about 1.275 inches. In some embodiments the, the length of the bullet is from about 0.580 inches to about 0.670 inches. In some embodiments, the length of the cartridge is about 1.135 inches to about 1.275 inches. In an aspect of the invention, an aspect ratio of the bullet length to the bullet diameter 72 (70/72) may be about 1.05 to about 2.00. In further aspects, the ratio may be about 1.35 to about 1.95. In an aspect of the invention, the ratio of the cartridge length to the bullet diameter 72 (74/72) may be about 2.30 to about 4.45. In further aspects, the ratio may be about 2.50 to about 3.30. In embodiments, the cartridges loaded may be 9 mm handgun cartridges.

The components of the housing and chassis are suitably formed from injection molded polymers although metal components may also be suitable. Gears, shafts, motors will suitably be formed of metal. The lifting wheel and shelf structure may be formed of polymers such as by injection molding.

Referring, to FIGS. 2A and 2B, an upward direction Z and a downward or lower direction −Z are illustrated using arrows labeled "Z" and "−Z," respectively. A forward direction Y and a rearward direction −Y are illustrated using arrows labeled "Y" and "−Y," respectively, in FIG. 3. Also, a starboard direction X and a port direction −X are illustrated using arrows labeled "X" and "−X," respectively. Various direction-indicating terms are used herein as a convenient way to discuss the objects shown in the figures. It will be appreciated that any direction indicating terms are related to the instant orientation of the object being described. It will also be appreciated that the objects described herein may assume various orientations without deviating from the spirit and scope of this detailed description. "Portion" when used herein may be part of a unitary thing or all of a unitary thing, or part or parts of a system without limitations to inclusion or exclusion of discrete components, parts or members.

The following United States patents are hereby incorporated by reference herein: U.S. Pat. Nos. 4,464,855, 4,689,909, 4,719,715, 4,827,651, 4,829,693, 4,888,902, 4,993,180, 5,249,386, 5,355,606, 5,377,436, 6,810,616, 6,178,683, 6,817,134, 7,059,077, 7,257,919, 7,383,657, 7,487,613, 7,503,138, 7,637,048, 7,805,874, 9,212,859, 9,239,198, 9,347,722 and 9,273,917.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A magazine loader comprising:

a chassis supporting a powered lifting wheel with a plurality of circumferentially spaced singularizing pockets at a periphery of the lifting wheel for receiving and lifting a plurality of cartridges serially from an unordered batch of cartridges placed in the interior of the lifting wheel, wherein the pockets are configured to lift singularized cartridges to be positioned in one directional orientation with respect to the cartridge's lengthwise axis serially to a discharge region where the cartridges are transferred serially through the discharge region;

a transfer portion defining a passageway positioned at an upper portion of the transfer portion adjacent the discharge region to serially receive the cartridges and direct the cartridges to a horizontal orientation; wherein the passageway comprises an axis parallel to the cartridge's lengthwise axis to allow rotation about the cartridge's lengthwise axis and to preclude rotation of the cartridges horizontally oriented to a non-horizontal orientation thereby preventing the cartridges from changing the directional orientation; and a magazine loading portion comprising a magazine receiver and a powered setting tool for urging cartridges, one-by-one, into a magazine placed in the magazine receiver, the setting tool comprising a lobe portion and a cartridge receiving void, the setting tool being positioned below a chute portion for receiving the cartridges into the cartridge receiving void to be urged into the magazine by the lobe portion.

2. The magazine loader of claim 1, wherein each pocket has a respective shelf that defines the pocket, and wherein each shelf is configured to retain each cartridge therein that is oriented in the proper directional orientation and to release each cartridge therein that is not oriented in the proper directional orientation.

3. The magazine loader of claim 2, wherein each shelf is shaped such that each pocket conforms to the cartridge shape, whereby when a cartridge is lifted by a shelf and is in the proper directional orientation the cartridge fully seats in the pocket and wherein when a cartridge is lifted that is not in the proper directional orientation the cartridge does not seat in the pocket.

4. The magazine loader of claim 1, comprising a deflector disposed on the chassis and positioned to interfere with the lifting of cartridges that do not have the proper directional orientation and to not interfere with the lifting of cartridges that have the proper directional orientation.

5. The magazine loader of claim 4, wherein the lifting wheel is provided with pockets that lift cartridges, and wherein the deflector extends from the chassis into each pocket as the lifting wheel is rotated, and wherein when a cartridge is the proper cartridge directional orientation in a pocket passing by the deflector, the deflector passes by a projectile end of said cartridge without contacting the cartridge.

6. The magazine loader of claim 4, wherein the deflector comprises an adjustable screw.

7. The magazine loader of claim 1, wherein the transfer portion comprises a curved chute portion.

8. The magazine loader of claim 1, wherein the setting tool comprising a rotatable lifting wheel with a central portion, and further comprising two lobe portions extending from the central portion, the setting tool further defining two cartridge receiving voids disposed between the lobe portions, wherein rotation of the setting tool urges the cartridge in the cartridge receiving void to into the magazine.

9. The magazine loader of claim 1, wherein the lifting wheel, the transfer portion, and the setting mechanism are all configured for 9 mm handgun cartridges.

10. A magazine loader comprising:

a chassis supporting a powered lifting wheel with a plurality of circumferentially spaced singularizing pockets at a periphery of the lifting wheel for receiving and lifting a plurality of cartridges serially from an unordered batch of cartridges placed in the interior of the lifting wheel, the lifting wheel singularizing the cartridges of the batch while raising the cartridges serially to a discharge region where the cartridges are transferred in a horizontal orientation serially through the discharge region;

a directional member that serially receives the cartridges and advances the cartridges positioned in one directional orientation with respect to the cartridge's lengthwise axis;

a transfer portion defining a passageway positioned adjacent the discharge region to serially receive the cartridges and direct the cartridges to a horizontal orientation; an upright stop surface that stops motion of the cartridges in the cartridge's lengthwise axis and, and a chute having a curvature having an axis parallel to the lengthwise axis of the cartridges that precludes the cartridges from rotating other than about the cartridges' lengthwise axis; and a magazine loading portion comprising a magazine receiver and a powered setting tool for urging cartridges, one-by-one, into a magazine placed in the magazine receiver, the setting tool comprising a rotatable lifting wheel with a central portion and two lobe portion extending from the central portion and defining two cartridge receiving voids between the lobe portions, the setting tool being positioned below the chute for receiving the cartridges into the cartridge receiving voids to be urged into the magazine rotation of the lobe portions of the setting tool.

11. The magazine loader of claim 10, wherein the directional member is disposed on the rotating lifting wheel, wherein the lifting wheel is provided with pockets that lift cartridges that are positioned in the proper directional orientation to the discharge region.

12. The magazine loader of claim 11, wherein each pocket has a respective shelf that defines the pocket, and wherein each shelf is configured to retain each cartridge therein that is oriented in the proper directional orientation and to release each cartridge therein that is not oriented in the proper directional orientation.

13. The magazine loader of claim 12, wherein each shelf is shaped such that each pocket conforms to the cartridge shape, whereby when a cartridge is lifted by a shelf and is in the proper directional orientation the cartridge fully seats in the pocket and wherein when a cartridge is lifted that is not in the proper directional orientation the cartridge does not seat in the pocket.

14. The magazine loader of claim 10, wherein the directional member is disposed on the chassis and comprises a deflector positioned to interfere with the lifting of cartridges that do not have the proper directional orientation and to not interfere with the lifting of cartridges that have the proper directional orientation.

15. The magazine loader of claim 14, wherein the lifting wheel is provided with pockets that lift cartridges, and wherein the deflector extends from the chassis into each pocket as the lifting wheel is rotated, and wherein when a cartridge is the proper cartridge directional orientation in a pocket passing by the deflector, the deflector passes by a projectile end of said cartridge without contacting the cartridge.

16. The magazine loader of claim 10, wherein the chute comprises a C-shaped chute portion.

17. The magazine loader of claim 10, wherein the lifting wheel, the transfer portion, and the setting mechanism are all configured for 9 mm handgun cartridges.

18. A magazine loader comprising:

a chassis supporting a powered lifting wheel with a plurality of circumferentially spaced singularizing pockets at a periphery of the lifting wheel for receiving and lifting a plurality of cartridges serially from an unordered batch of cartridges placed in the interior of the lifting wheel, wherein the pockets are configured to lift singularized cartridges to be positioned in one directional orientation with respect to the cartridge's lengthwise axis serially to a discharge region where the cartridges are transferred serially through the discharge region;

a transfer portion defining a passageway positioned at an upper portion of the transfer portion adjacent the discharge region to serially receive the cartridges; and a magazine loading portion comprising a magazine receiver to receive the cartridges from the transfer portion and a powered setting tool for urging cartridges, one-by-one, into a magazine placed in the magazine receiver, the setting tool comprising a lobe portion and a cartridge receiving void, the setting tool being positioned below a chute portion for receiving the cartridges into the cartridge receiving void to be urged into the magazine by the lobe portion.

19. The magazine loader of claim 18, wherein the passageway of the transfer portion directs the cartridges to a horizontal orientation; wherein the passageway comprises an axis parallel to the cartridge's lengthwise axis to allow rotation about the cartridge's lengthwise axis and to preclude rotation of the cartridges horizontally oriented to a non-horizontal orientation thereby preventing the cartridges from changing the directional orientation.

20. The magazine loader of claim 18, wherein the transfer portion comprises a curved chute portion.

* * * * *